US007109859B2

(12) United States Patent
Peeters

(10) Patent No.: US 7,109,859 B2
(45) Date of Patent: Sep. 19, 2006

(54) METHOD AND APPARATUS FOR WIDE AREA SURVEILLANCE OF A TERRORIST OR PERSONAL THREAT

(75) Inventor: John Peeters, Bethesda, MD (US)

(73) Assignee: Gentag, Inc., Bethesda, MD (US)

( * ) Notice: Subject to any disclaimer, the term of this patent is extended or adjusted under 35 U.S.C. 154(b) by 606 days.

(21) Appl. No.: 10/382,606

(22) Filed: Mar. 6, 2003

(65) Prior Publication Data

US 2004/0119591 A1 Jun. 24, 2004

Related U.S. Application Data

(60) Provisional application No. 60/436,024, filed on Dec. 23, 2002.

(51) Int. Cl.
*G08B 1/08* (2006.01)

(52) U.S. Cl. ..... 340/539.11; 340/539.22

(58) Field of Classification Search ..... 340/539.11, 340/539.22, 539.24, 539.26
See application file for complete search history.

(56) References Cited

U.S. PATENT DOCUMENTS

| | | | | |
|---|---|---|---|---|
| 5,132,968 | A | 7/1992 | Cephus | |
| 5,235,318 | A | 8/1993 | Schulcz | |
| 5,339,339 | A | 8/1994 | Petitclerc et al. | |
| 5,798,458 | A | 8/1998 | Monroe | |
| 6,023,223 | A | 2/2000 | Baxter, Jr. | |
| 6,028,514 | A * | 2/2000 | Lemelson et al. | 340/539.13 |
| 6,031,454 | A | 2/2000 | Lovejoy et al. | |
| 6,084,510 | A | 7/2000 | Lemelson et al. | |
| 6,100,806 | A | 8/2000 | Gaukel | |
| 6,198,390 | B1 * | 3/2001 | Schlager et al. | 340/540 |
| 6,225,901 | B1 * | 5/2001 | Kail, IV | 340/539.11 |
| 6,238,337 | B1 | 5/2001 | Kambhatla et al. | |
| 6,282,410 | B1 | 8/2001 | Monsen, III et al. | |
| 6,396,416 | B1 | 5/2002 | Kuusela et al. | |
| 2002/0003470 | A1 | 1/2002 | Auerbach | |
| 2004/0149918 | A1 | 8/2004 | Craig et al. | |

OTHER PUBLICATIONS

Sirringhaus, H.; Kawase, T.; Friend, R.H.; Shimoda, T.; Inbasekaran, M.; Wu, W.; Woo, E.P. High-Resolution Inkjet Printing of All-Polymer Transistor Circuits. Science, www.sciencemag.org, vol. 290, pp. 2123-2126. (Dec. 15, 2000).

(Continued)

*Primary Examiner*—Daryl C Pope
(74) *Attorney, Agent, or Firm*—Dickinson Wright PLLC

(57) ABSTRACT

The present invention is related to a means for detecting external threats by the use of methods and apparatuses for the wide area detection of chemical, radiological or biological threats using modified personal wireless devices combined with new advanced micro and nanosensor technologies. A cost effective method is provided for wide area surveillance of a potential terrorist or personal threat. Personal electronic devices such as mobile phones, PDAs or watches, in combination with new microsensor technologies described herein, can be used as a new type of platform detection technology for wide area surveillance of major threats. A "Homeland Security" chip is further provided which combines the elements of geo-location, remote wireless communication and sensing into a single chip. The personal electronic devices can be further equipped for detecting various medically related threats. Similarly modified personal devices can be used to detect external threats that are person-specific.

72 Claims, 12 Drawing Sheets

OTHER PUBLICATIONS

Hausmann, Dennis; Becker, Jill; Wang, Shenglong; Gordon, Roy G. Rapid Vapor Deposition of Highly Conformal Silica Nanolaminates. Science, www.sciencemag.org, vol. 298, pp. 403-406 (Oct. 11, 2002).

Angelopoulos, M. Conducting Polymers in Microelectronics, IBM Journal of Research and Development, vol. 45, No. 1. (2001) www.research.ibm.com/journal/rd/451/angelopoulos.mtml.

Donhauser, Z.J.; Mantooth, B.A.; Kelly, K.F.; Bumm, L.A.; Monnell, J.D.; Stapleton, J.J.; Price Jr., D.W.; Rawlett, A.M.; Allara, D.L.; Tour, J.M.; Weiss, P.S. Conductance Switching in Single Molecules Through Conformational Changes. Science, vol. 292, pp. 2303-2307, www.sciencemag.org (Jun. 22, 2001).

Zulicke, Ulrich. Ultrasmall Wires Get Excited. Science, vol. 295, pp. 810-811, www.sciencemag.org (Feb. 1, 2002).

Cui, Yi; Wei, Qingqiao; Park, Hongkun; Lieber, Charles M. Nanowire Nanosensors for Highly Sensitive and Selective Detection of Biological and Chemical Species. Science, vol. 293, pp. 1289-1292. (August 17, 2001).

Wrolstad, Jay. Siemens' Cell-Network Service Tracks Assets, People. Wireless NewsFactor, www.wirelessnewsfactor.com/perl/printer/20997 (Mar. 14, 2003).

Merritt, Rick. From Sea to Shining Sea. Electronic Engineering Times, pp. 18-19, 24-25 (Jul. 14, 2003).

Wrolstad, Jay. Handheld Sniffs Out Potential Terrorist Threats. Wireless NewsFactor. www.wirelessnewsfactor.com/perl/story/21309.html (April 18, 2003).

* cited by examiner

METHOD AND APPARATUS FOR WIDE AREA SURVEILLANCE OF A TERRORIST OR PERSONAL THREAT

This application claims priority to U.S. provisional application 60/436,024 entitled "Method And Apparatus For Wide Area Surveillance Of A Terrorist Or Personal Threat", filed on Dec. 23, 2002.

FIELD OF THE INVENTION

The present invention relates to external threat analyses, and in particular to methods and apparatuses for the wide area detection of chemical, radiological or biological threats using modified personal wireless devices combined with new advanced micro and nanosensor technologies.

BACKGROUND OF THE INVENTION

Wide area surveillance is defined here as the ability to detect a threat anywhere over a wide geographical area such as a large city, a county, a State or even an entire country. Since the attacks of Sep. 11, 2001 in the United States, this issue has become critical for countries that are concerned with broad and indiscriminate large-scale terrorist threats. Of particular concern is the threat of "dirty bombs" that could contaminate broad geographical areas and have very serious negative economic consequences for an entire country. Equally the threat of a biological attack with agents such as anthrax has become a serious national and international concern. Personal threat is defined here as any chemical, biological or radiological hazard that can threaten the health or the life of an individual.

A number of different detector technologies are currently commercially available or in the process of being developed to detect chemical, biological or radiological hazards. However these technologies are generally limited in their detection capabilities to small or immediate vicinity areas. Because of the diffusion effects, particularly for chemical or biological releases, point detection technologies can only be effective if the hazard or threat comes in close proximity to the sensor or detector itself. Such instances occur for example for baggage screening technologies used at airports where individual pieces of luggage are mechanically brought in very close proximity to the detectors. A few emerging technologies such as Berkeley Nucleonics' Smart Area Monitor (SAM) for radiation or some types of laser-based detectors for chemicals allow more remote detection (usually within a few tens of feet away from a source) but these technologies rely on very sensitive sensors that also require complex and expensive electronics.

Current detectors for chemical, radiological or biological hazards are not well suited either individually or in combination for wide area surveillance simply because the cost of deploying and networking such detectors over large geographical areas would make the cost of an effective nationwide detection blanket completely unfeasible. Additionally the chance of missing a terrorist threat such as a "dirty bomb" would be very high because the probability of having a detector or a partial sensor network in the right place and at the right time would be very low. Furthermore when single point detectors are used a single detection event might be considered as a false positive and therefore be ignored.

The US White House Office of Homeland Security has recognized this problem and has correctly pointed out in its National Strategy for Homeland Security (July 2002) that effective wide area surveillance in a large country like the United States can only be accomplished with the broad participation of the public. However no clear implementation plan or technology solution has yet been proposed or developed. Public participation is key to the success of a Homeland Security initiative and several recent examples in the United States and in other countries like Israel show how leads provided by the public can help solve or prevent terrorist events.

A number of technical solutions have been proposed for remote monitoring. U.S. Pat. No. 6,100,806 to Gaukel discloses a GPS based geo-location device comprising a remote tracking database, a means for communication and a body worn device for the purpose of tracking individuals, and particularly parolees. The Gaukel system must use the GPS system, a wristband sensor unit and a separate "cellular bag". Furthermore the system disclosed by Gaukel must rely on periodic monitoring at predetermined intervals using a database manager and continuous two-way use of a mobile phone implying high overall monitoring costs.

U.S. Pat. No. 5,235,318 to Schulez describes a personal radiation dosimeter with built-in communication capabilities for the automatic monitoring of people entering or leaving certain areas or zones. The Schulez system allows remote surveillance by a computer link but requires a specific reader system to be installed in each of the areas that are monitored.

U.S. Pat. No. US2002/0003470 A1 to Auerbach describes a system for the geolocation of gunshots. The Auerbach patent describes a network of sensors to detect and geolocate gunshots and signatures thereof using GPS and triangulation methods.

U.S. Pat. No. 6,282,410 B1 to Monsen, III et al. describes a system for the remote monitoring of workers in hazardous environments. The Monsen system is a complete system including radiation and video monitoring and is specifically tailored to certain types of remote worker monitoring situations.

U.S. Pat. No. 5,798,458 to Monroe describes an acoustic sensor system for the detection of threats including terrorist threats to aircrafts.

U.S. Pat. No. 5,339,339 to Petitclerc et al. describes a process to carry out an inspection or monitoring around a nuclear site.

U.S. Pat. No. 6,238,337 B1 to Kambhatla et al. describes a method to detect an emerging illness using embedded sensors in different devices to detect the onset of a disease in an individual or the general population.

U.S. Pat. No. 5,132,968 to Cephus describes a network of sensors and method to connect with said sensors to gather environmental information remotely.

U.S. Pat. No. 6,396,416 B1 to Kuusela et al. describes a mobile phone with a plug in module for medical monitoring purposes. The technology described by Kuusela focuses on ECG, EEG and EMG functions that are measurable at close range remotely using specialized sensor modules.

U.S. Pat. No. 6,023,223 to Baxter, Jr. describes an early warning system with remote sensors for measuring environmental conditions.

U.S. Pat. No. 6,031,454 issued Feb. 29, 2002, entitled "Worker-Specific Exposure Monitor and Method for Surveillance of Workers" to Michael L. Lovejoy, John P. Peeters and A. Wayne Johnson, is incorporated herein by reference in its entirety.

U.S. Pat. No. 6,031,454 to Lovejoy et al. describes a method for a worker-specific exposure monitor with remote geo-location and communication capabilities and a swappable sensor module. The patent by Lovejoy et al. describes a means to geolocate workers using land-based triangulation methods, provides for two-way communication and provides a means to determine any type of exposure using a swappable micro or nanosensor module. The patent also describes person-specific genomic applications for the technology.

In addition to these cited patent references the following scientific literature is cited for reference for this invention:

H. Sirringhaus et al. High-Resolution Inkjet Printing of All-Polymer Transistor Circuits. *Science*. VOL 290. Pages 2123–2126. 15 Dec. 2000.

D. Hausmann et al. Rapid Vapor Deposition of Highly Conformal Silica Nanolaminates. *Science*. VOL 298. Pages 402–406. 11 Oct. 2002.

M. Angelopoulos. Conducting polymers in microelectronics. *IBM Journal of Research and Development*. VOL. 45. Number 1. 2001.

J. Li et al. Ion-beam sculpting at nanometer length scales. *Nature*. VOL 412. Pages 166–169. Jul. 12, 2001.

Donhauser et al. Conductance Switching in Single Molecules Through Conformational Changes. *Science*. VOL 292. Pages 2303–2307. 22 Jun. 2001.

Li-Qun Gu et al. Capture of a Single Molecule in a Nanocavity. *Science*. VOL 291. Pages 636–640. 26 Jan. 2001.

U. Zülicke. Ultrasmall Wires Get Excited. *Science*. VOL 295. Pages 810–811. 1 Feb. 2002.

Y. Cui et al. Nanowire Nanosensor for Highly Sensitive and Selective Detection of Biology and Chemical Species. *Science* VOL 293. Pages 1289–1292. 11 Aug. 2001.

The present technology presents a new, completely integrated, flexible and cost effective solution to build upon and complement existing detection technologies, networks and systems and specifically will help fill in the current detection gaps to make wide area threat surveillance possible by enhancing existing electronic and security infrastructures. Specifically the technology described here provides a means to place a new type of highly flexible, modular, low cost detector technology everywhere within a given country and principally where the threats will be the greatest that is within the most highly populated areas. The technology also allows individuals to self-monitor and self protect themselves from external hazards and threats.

The technology is possible by using new advanced sensor technologies that are described herein and that form an integral part of this invention.

SUMMARY OF THE INVENTION

In one embodiment, a modified personal networkable wireless device that is typically carried on a person and is used daily such as a mobile phone, a Personal Digital Assistant (PDA), a pager or a watch is provided to form the basis for a nationwide surveillance system against major terrorist threats. The entire surveillance system is designed to be completely flexible and modular and to make full use of existing or emerging electronic technologies for unique identification, sensing, two-way communication and geolocation. A particular emphasis of the technology is on cost effectiveness so that wide area surveillance can become possible. Because of the broad and ubiquitous use and distribution of mobile phones or watches, the technology will maximize the chances of an encounter between the bearer of a modified personal device and a potential threat. In fact repeated encounters can be expected, thereby providing a means to eliminate or reduce false-positives.

In one embodiment, a personal wireless device such as a mobile phone includes a built-in slot to allow the insertion of an integrated sensor module for the detection of a terrorist threat or an external hazard that can threaten the health or wellbeing of a person. The technology allows multiple types of sensors to be used in the same device interchangeably. Each sensor module may be a cartridge containing a multitude of very small sensors at the micron, sub micron or nano range. The types of sensors used within the sensor module include radiation sensors, chemical sensors, biological sensors or a combination thereof. A key feature is that these sensor modules are of exactly the same size, are fully interchangeable, are self-contained and contain all the necessary electronic components and control codes for a "plug and play" type technology.

In one embodiment a miniature pre-calibrated radiation sensor on a chip is provided that includes a reference and at least one measurement device based the fact that radiation is known to interact with certain materials such as crystals and with certain electronic components.

In another related embodiment, a miniature sensor is built directly into a personal wireless device such as a mobile phone and most preferably is a miniature electronic radiation sensor that detects small physico-chemical changes caused by an external source of radiation. Such modified mobile phones are made available to the public and allow the remote detection of a potential terrorist threat such as a "dirty bomb". False positives can be eliminated by network probability algorithms and by manual verification according to protocols described herein.

In accordance with another embodiment a disposable nose technology is provided whose purpose is to allow the long-term monitoring of external chemical threats or hazards using a personal electronic device such as a mobile phone, a Personal Digital Assistant or a watch.

In another embodiment an anthrax detector on a chip is provided to allow the detection of an anthrax threat using a small personal electronic device and based on a novel type of dry electronic microchip that can operate in the air and does not require complex microfluidics stages of separation, amplification and analysis.

In another embodiment a combination of a radiation and a chemical sensor on a low cost dual use chip is provided for the purposes of this invention.

In yet another embodiment the use of Embedded Passives is made to provide a means to include a chemical sensor array within the electronics of a personal device without any modification of size and without addition in manufacturing costs.

In another embodiment, the elements of geo-location, remote wireless communication and sensing are combined into a single "Homeland Security" chip that can be added onto any personal or electronic device and function autonomously from said device, thereby providing a convenient means to rapidly provide global threat detection capabilities within a given country.

In another embodiment the sensors and electronic components of the present invention allow custom tailoring and detection of external threats or hazards that are unique to a given person.

In another embodiment, an alternative technology for the wide area surveillance of a major threat is provided. Rather than building a sensor directly into a personal device such as a mobile phone or providing a new type of mobile phone with a slot to insert an electronic modular sensor cartridge, a flexible, programmable and completely modular miniature security wireless device is provided that is of low cost, is of very low power consumption and is of small size so that it can be hidden in any truck, shipping container or bus. The device is made in such a way that it can be easily coupled with any type of commercial-of-the-shelf (COTS) precalibrated sensor or sensor module, can be geo-positioned and uses methods to reduce or eliminate monthly fees for two-way communication.

In another embodiment a transparent surveillance network is provided for the detection of a terrorist threat and in particular the detection of a dirty bomb based on the use of modified mobile phones with built-in components to detect certain neutron or gamma signatures.

It is thus an object of the present invention to provide a novel, comprehensive, low cost and easy to use method for wide area surveillance of a terrorist threat or external hazard. The technology is completely modular and flexible thereby allowing individual people, corporations, States and even entire countries to tailor the technology to their own respective needs and security concerns.

BRIEF DESCRIPTION OF THE DRAWINGS

The foregoing features of the invention will be more readily understood by reference to the following detailed description, taken with reference to the accompanying drawings, in which.

DETAILED DESCRIPTION OF THE PREFERRED EMBODIMENTS

Figure 1:
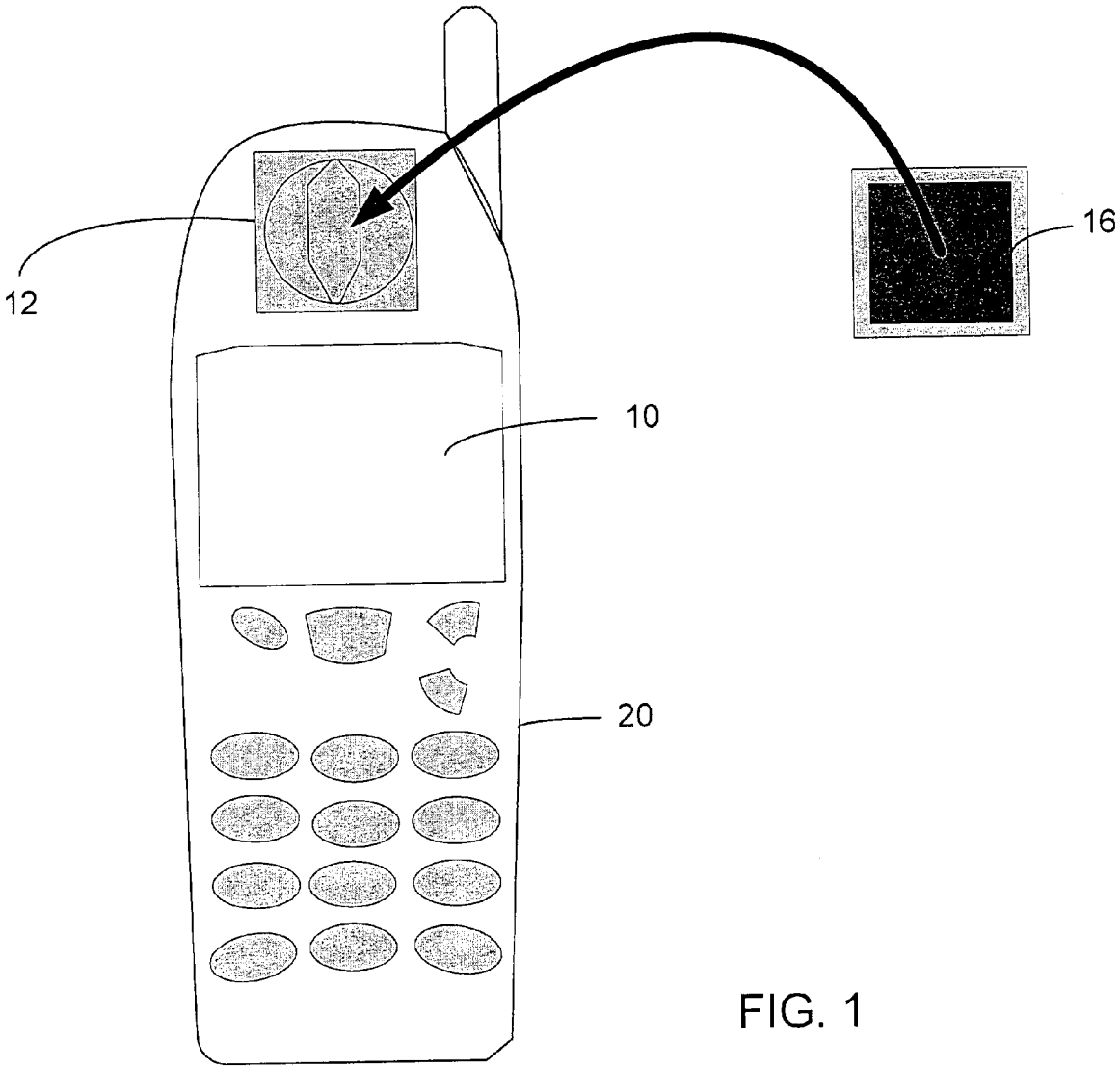
FIG. 1 is a front drawing of a mobile phone with a built-in insertion slot to receive a sensor module for a chemical, radiological or biological threat.

The following detailed description is organized into individual discussions of the several components that comprise the entire system of this invention. There are several subsystems in the invention, each having different possible configurations. One of the core aims of this invention is to be able to provide a new and highly cost effective way to provide wide area surveillance of a major threat. In order to achieve this maximal use is made of the following three technologies:

a) Geolocation

A first component that is used for this technology is the triangulation technology for geo-positioning. There are two systems currently available and each is based on the same principle. The first one is triangulation based on GPS technology where signals are provided by geo-stationary satellites. In this case the calculation for the geolocation are done in-situ within the portable device. Very high precision can be achieved (i.e. ~1 meter) and, with the advent of the miniature GPS chip recently announced by Motorola and called "Motorola Instant GPS", the technology may become incorporated into extremely small devices (e.g. mobile phones and watches). A drawback of the GPS technology is that it does not work under cover.

The second approach is the triangulation method described in U.S. Pat. No. 6,031,454 where geo-positioning is calculated by triangulation on land-based transmission systems (e.g. stationary mobile phone towers) by either signal time-difference-on-arrival or by angle-on-arrival. The technology has the following three advantages: the first is that the calculations are done ex-situ (i.e. at the location of the transmission towers or network), meaning that the device that needs to be geolocated can be extremely small and be of very low cost. The second major advantage is that existing mobile phones and existing transmission towers can be used as such by calculating time to signal from a mobile phone to the closest cell towers. A third advantage as described in U.S. Pat. No. 6,031,454 is that the technology works under cover (and in large cities). A potential drawback of the technology is that it is somewhat less accurate than GPS and geolocation precision is usually within a few meters. In response to the 1996 mandate by the Federal Communications Commission (or FCC) in the US for geolocation for emergency calls Verizon has recently announced that is will use the land-based triangulation approach, rather than the GPS-based method (which requires the issuance of new more expensive GPS chip equiped mobile phones).

In the following description either GPS or land-based triangulation technologies are used and in fact the two can and should be used concurrently.

b) Wireless Networks

A second technology that is used herein is any of the wireless networks that are currently in place or being installed around the world and provide various forms of telecommunication capabilities. These include mobile phone based networks based on the Global System for Mobile Communication or GSM, the CDMA, TDMA and GPRS protocols, any wireless links to an existing network such as the Internet through protocols such as Bluetooth, secure military networks, satellite links, etc.

c) Emergency Response Systems

A third basic technology that is used herein is any of the emergency systems currently in place including the 911 system and the emerging Enhanced 911 (or E911) system in the United States. Additional emergency response systems include the Homeland Security networks being put in place in the US, military networks, police networks or systems that are either existing or being installed by individual industries, States or Governments concerned with given security issues.

The following embodiments represent new technologies and form an integral part of this invention.

Nationwide Transparent Surveillance Network

In a first embodiment a widely used electronic device such as a mobile phone, a PDA or a watch having telecommunication capabilities, and the associated wireless networks thereof are used as a basis to provide a new type of technology platform for a nationwide surveillance system to detect a potential terrorist threat. The electronic devices may be selected from various suppliers in the microelectronic industries including, but not limited to, Motorola®, Nokia® L-3 Communications®, Palm®, Citizens®, and other various suppliers. The system provides all the necessary automated components for unique identification, two-way communication, geolocation and associated electronics. In addition the system is ubiquitous in most countries since devices such as mobile phones are already carried by almost everyone worldwide. Because of their broad distribution, the chances are maximized of an encounter between the bearer of the device and a potential threat. In fact repeated encounters can be expected, thereby providing a means to eliminate or reduce false-positives. Mobile phone users already provide a significant contribution to the detection of crime or of potential terrorist threats. What is currently missing to make this detection means even more efficient and automated is a modification of existing mobile phones by the addition of new sensor technologies.

This new technology and the integration thereof into existing networks for the purpose of wide area surveillance and threat analyses is one of the purposes of the present invention. Once these modifications are implemented the prospects of a very low cost, nationwide, transparent and highly flexible network of surveillance can be contemplated for any country adopting this system.

Personal Devices with Modular Sensors for External Threats

Referring now to FIG. 1 of the drawings, a broadly used personal electronic device 10 having a wireless network, geolocation, two-way communication capabilities, a unique signature ID and is typically worn or used by a person is provided. The device could be any of the following systems: a mobile or cell phone, a wireless Personal Digital Assistant or PDA, an electronic watch with embedded wireless capabilities, a two-way pager or a two way e-mail device such as a BlackBerry™. As previously suggested, such devices may be provided by Motorola®, Nokia® L-3 Communications®, Palm®, Citizens®, and other various suppliers. The telecommunication functionality of the electronic device, such as communication provided by a transceiver, provides interaction between the wireless device and remote locations. A most preferred embodiment is the use of a mobile phone or a modified watch and reference is made herein mainly to mobile phones although it is understood that any of the above cited devices could be used. Furthermore, as provided in the industry, the electronic devices are provided with a power supply system, such as a built-in battery system. The device has a built-in slot 12 capable of receiving a sensor or a sensor module 16 that together form an integrated dual use unit 20.

The basic electronic configurations, characteristics and applications of the pluggable sensor or sensor module have already been described in detail previously in U.S. Pat. No. 6,031,454 by the present inventor and is herein incorporated by reference. As indicated in U.S. Pat. No. 6,031,454 the sensor module technology allows multiple types of sensors to be used in the same device interchangeably. Each sensor module may be an integrated sensor cartridge containing a multitude of very small sensors or nanosensors. The types of sensors that can be included in a module are described in detail below but a key feature is that these sensor modules are of exactly the same size, are fully interchangeable and are self-contained.

Figure 2:
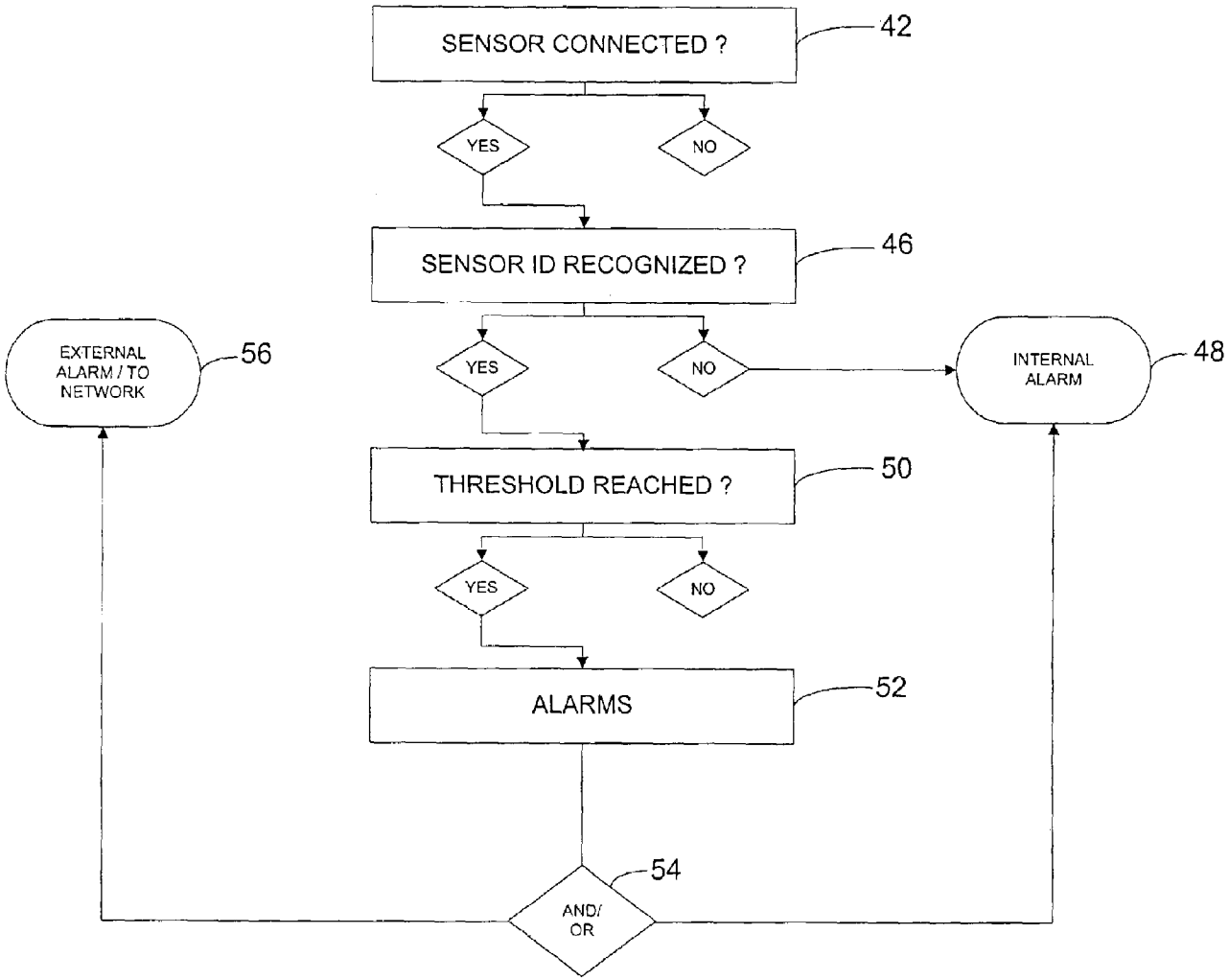
FIG. 2 is a diagram of a preferred electronic pathway in response to the insertion of a sensor module into a personal electronic wireless device such as a mobile phone.

Referring now to FIG. 2 the plugging of sensor module 16 into device 10 closes an interrogation loop 42 by a microcontroller or a microprocessor within the device (see FIG. 2 of U.S. Pat. No. 6,031,454 for details not shown herein). Subsequently the microcontroller interrogates the sensor module as shown in 46. If the sensor module is not recognized an external alarm 48 is activated which could be a warning on the external display and/or an audible signal. Sensor module 16 includes a reference table and is either pre-calibrated or is programmable via an EEPRoM or other means. The sensor module is fully self-contained in terms of electronics, sensor reference tables and IDs, connection means, etc. and the concept described here is essentially a "plug and play" type technology.

It should be noted that for some sensor applications, more extensive microprocessor capabilities might be required to perform calculations on the fly. A number of new advanced microchips which include programmable internal components of logic, processor and memory are currently commercially available and reference is made for instance to the Field Programmable Gate Array (FPGA), the CoolRunner™ or the Virtex-II Pro chips from the Xilinx Corporation. The precise architecture that is used depends on the degree of use that is made of the microprocessing capabilities that are already present in the mobile phone or personal device and hence in the present application "microcontroller" and "microprocessor" are used interchangeably. Generally the aim of the present invention is to minimize both power and processing requirements of the sensor to reduce power consumption and size as much as possible. New advances in sub-micron electronics and nanoelectronics are contemplated and are particularly relevant to allow the sensors described herein to fit into a mobile phone or even a watch. Additionally the use of new fabrication methods and technologies such as Embedded Passives may also be made, as described below.

In general, a type of control system for the electronic device is provided by the microprocessor or microcontroller and the memory system. If the pre-set threshold 50 stored in the memory is reached for the sensor module for either one or a combination of external hazard factors then the sensor module notifies the microcontroller or microprocessor within the device and alarms 52 are generated which can be either internal 48 or external 56 according to a pre-set decision 54. External alarm 56 can be sent to a remote network as described more fully below. If transmission is done to a wireless network typically the following information is relayed: ID (mobile phone number), passcodes, geolocation coordinates (if a GPS chip is present), sensor module type and ID, hazards and hazard levels and either a pre-recorded message or an alert activation code or codes. Some or all of these data may be encrypted depending on the networks and precise applications that are used. This type of information serves as a notification means for alerting individuals about the various factors being detected by the control system and sensor module.

New Sensors

In order to make the present invention feasible in terms of integration into a miniature device like a mobile phone, new electronic microsensor technologies are necessary. Recent advances in microfabrication, MEMS and nanotechnology now allow the fabrication of micron and sub-micron electronic sensor or sensor arrays that are very small, reliable and have extremely small power needs. The sensors can be so small in fact that swappable nanosensor arrays (as described in U.S. Pat. No. 6,031,454) could be included into watches or other devices carried directly on a person. Many types of microsensors, microsensor arrays or nanosensors are currently under development and include physical hazard sensors, chemical sensors and "nose" technologies and biological sensors (or biosensors) that detect unique biological signatures and therefore can recognize a major biological hazard such as anthrax.

In this application the following types of electronic sensors are contemplated either alone or in combination for insertion into sensor module 16, by being built directly into a mobile phone, or by being included into other small miniature devices meant to detect a terrorist or external personal threat.

Radiation Sensor on a Chip

Radiation sensor is defined here as a means to detect signals of either fast neutrons, thermal neutrons, x-rays, alpha, beta or gamma rays coming from the decay of radioactive materials and that may reveal the presence of a "dirty bomb", an atomic weapon or a source of nuclear materials.

In one embodiment device 10 includes a miniature electronic radiation sensor that may either be included in swappable sensor module 16 or may be directly build into the device. This build-in miniature device may be a standard pre-calibrated radiation sensor (based on for example a miniature energy compensated halogen-quenched Geiger-Müller tube), other miniature electronic radiation sensor technologies currently available on the market such as the Direct Ion Storage (DIS) MOSFET transistor made by the RADOS Corporation, sensors still under development, or any of the technologies described below.

Ideally the built-in radiation sensor is of a novel type that is highly sensitive, accurate, operating at low voltage and at room temperature, not affected by EM or RF interference and small enough to fit on a small chip within a mobile phone with little or no addition to the current size of these devices. The principal purpose of this chip is not to quantify precisely a radiation source but to be able to detect a threshold for the presence of such a potential source.

Figure 3A:
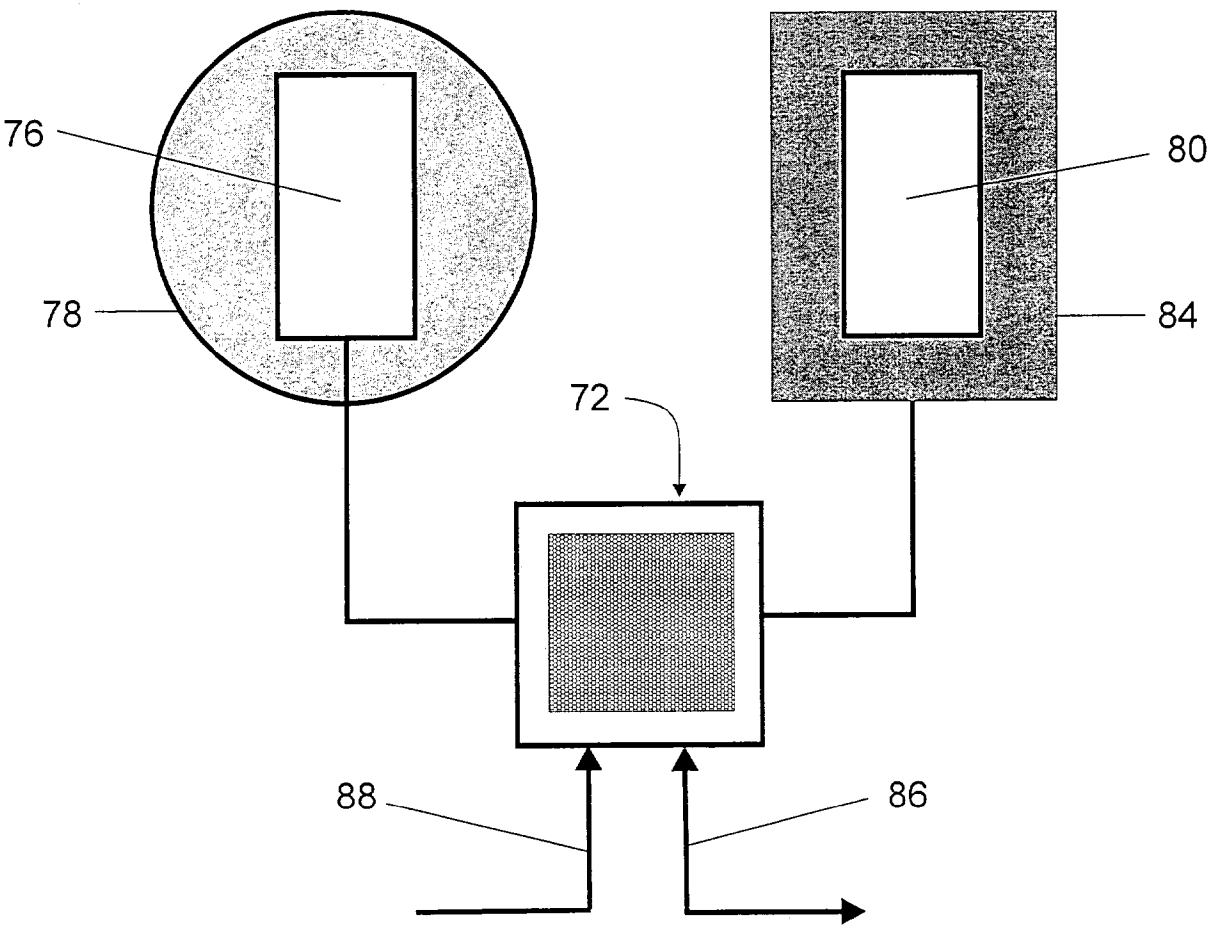
FIG. 3A is a design for a miniature electronic radiation detector on a chip small enough to fit within the devices described here and having a measurement and a control device.

Referring now to FIG. 3A a programmable miniature microcontroller or microprocessor 72 with a memory that can either be included within sensor module 16 or be directly built into a personal device is connected in parallel to a minimum of two symmetrical and highly sensitive electronic microdevices 76 and 80. Device 76 is specifically built to be as sensitive as possible to radiation whereas device 80, which is the reference, is specifically built to be as insensitive as possible to radiation and may include shielding 84 to further protect it. Shielding 84 may be a substance known to stop radiation by atomic density (such as a dense metal like lead), by absorption or quenching (such as certain crystals) or by reflection such as beryllium (Be) for neutrons. Device 76 may include an optional miniature concave disk 78 made for example of beryllium to concentrate an incoming radiation flux onto detector 76. Such dish is preferentially made of Be9, which will not only focus the signal but will amplify it since Be9, when hit by a fast neutron changes to Be8 releasing two thermal neutrons.

Microdevices 76 and 80 are similar in all aspects except their inherent electronic sensitivity to radiation. They are specifically built to work at low voltages and at room temperature. Examples of such devices include a clock (or a quartz microbalance sensor) with and without doping or coating of the quartz, a hardened and "soft" programmable device (PROM), a shielded and unshielded low noise diode, a coated and uncoated MEMS sensor or other high speed and sensitive microelectronic devices that may be present in the mobile phone or device and that can be used as a dual sensor-reference type technology. Doping or coating may include the use of boron 10 or lithium that are known to react strongly with neutrons, one of the radiation signature components measurable remotely for atomic weapons and certain types of "dirty bombs". In terms of doping or coating for x-rays and gamma rays (another remote signature component for certain dirty bombs) the following may be used: sodium iodide, cesium iodide, cadmium telluride, cadmium zinc telluride, gallium arsenide, mercuric iodide either pure or in combination with other elements that can react with gamma radiation. Doping may also include certain metals or other chemicals, depending on the application and fabrication method.

If a multiple clock design is used, and once the device is properly calibrated, a radiation event may cause a frequency shift in microdevice 76 that can then be measured precisely by microcontroller or microprocessor 72 and assessed against preset calibration standards stored in memory. Calibration in this instance is very important since background radiation is present everywhere and can vary from one geographic location to the other. Device 80 is not sensitive (or much is less sensitive) and this difference is measurable electronically and at very low battery cost. Device 72 may be "hardened" to radiation as well as all other sensitive electronic components within the device to avoid measurement and communication problems.

Quartz crystals in clocks are known to be sensitive to radiation and this sensitivity is known to change with minute changes in the properties or purity of the crystal. Additionally current state-of-the-art radiation detectors are based on radiation absorption in very dense crystals including sodium iodide, cesium iodide or cadmium zinc telluride. Therefore a two-clock design based on two tuned crystals with two completely different sensitivities to ionizing radiation may be an effective way to build a miniature radiation sensor on a chip small enough to fit into a mobile phone or even a watch. Frequency tuning or calibration may be based for example on the use of gold (for the reference) on the one hand and boron doping on the other. Using the technology described in FIG. 3A even if the vibration frequency spectra of the crystals are of different values (because the crystals are different) any changes can be assessed by the microcontroller and compared to an internal reference table stored in internal memory or in an external EEPRoM (not shown). In addition the programmable microcontroller allows precise individual calibration of each chip.

In addition to the multiple clock design, other methods and technologies can be used provided that their size allows insertion into the personal device such as a mobile phone, a watch or a PDA. One example is based on specially designed and doped diode circuits and small conductivity differences measurements. The design in FIG. 3A in fact lends itself to be used with any small circuit, MEMS sensor or technology where there is an interface between a capture or reaction surface and a small electrical circuit.

Figure 3B:
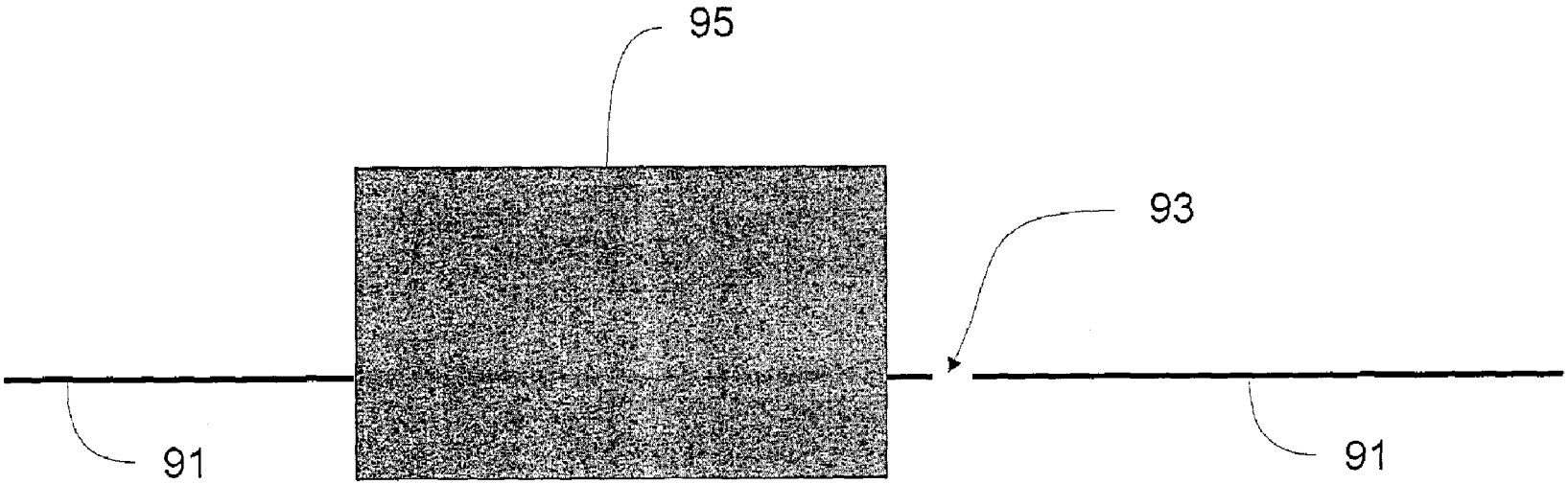
FIG. 3B is an electron tunneling radiation measurement nanodevice.

In addition new advances in nanotechnology may also allow such measurements be done at the sub-micron or nano circuit level. Referring now to FIG. 3B and to U. Zülicke. "Ultrasmall Wires Get Excited". (*Science* VOL 295. Pages 810–811. 1 Feb. 2002) and Y. Cui et al. "Nanowire Nanosensor for Highly Sensitive and Selective Detection of Biology and Chemical Species". (*Science* VOL 293. Pages 1289–1292. 11 Aug. 2001) one can fabricate an embedded radiation nanosensor using boron-doped silicon nanowires (SiNWs) 91 or other nanowires and a small gap or a gate 93 that allows the measurement of the tunneling of electrons based on a nearby ionization or excitation event. The excitation of the boron by an external source of neutrons either within the doped nanowire itself or in a capture surface area 95 immediately adjacent would cause a shift in electron tunneling that can then be measured. The gate area is typically non conductive and a voltage bias may be applied between the two sides of the gap. Such a nano radiation sensor could be built as part of a micro or nano transistor or circuit and would be so small that it would easily fit within and be a component of the circuitry of a watch. Area 95 is typically much larger than the wire area and may be embedded as an entire layer of the chip to maximize the capture surface. In addition, multiple embedded capture areas 95 may be built and may be oriented at 90 degrees one from the other to ensure that an optimized 360 capture surface is provided. The embedded capture areas consist of either lithium or boron 6.

Whatever design is used a particular emphasis of the present embodiment is the use of a radiation sensor on a chip that is extremely small and of very low power consumption. For example the radiation nanowire gap boron sensor of FIG. 3B may not use any current at all because the gaps in the nanosensor would be "off" until the nanocircuit is briefly turned "on" by an external radiation event which causes a sufficient charge potential to allow electron tunneling to occur. This in turn may be detected, amplified then lead to the activation of alarms and the communication means that would otherwise be off thereby minimizing battery use or any other power supply system. Power consumption may be so low in fact that a solar cell may be sufficient to power the entire sensor, as described in U.S. Pat. No. 6,031,454.

In addition to size what is particularly important in this given patent application is to fully appreciate the many different applications that are possible for each technology component. For instance for automated transparent wide area surveillance of a "dirty bomb" or a hidden atomic weapon as described below the calibration of the radiation sensor on a chip may be different from the calibration of the chip for other applications (such as a personal dosimeter). The chip for the wide area surveillance would be typically less sensitive to background radiation noise and may include special pre-programmed codes to recognize only certain radiation signatures that are characteristic of "dirty bombs". Such signatures can be coded into the device described in FIG. 3A where multiple detectors would be used and one sensor would measure neutrons and the other gamma radiation. It is anticipated for this technology that a dirty bomb or a hidden atomic weapon will not be shielded sufficiently and will be a significant radiation source measurable remotely. Such radiation sensor technology is provided by various industries including, but not limited to, Canberra and Smiths.

Chemical Sensors and Noses

A number of different chemical sensor technologies on a chip are currently available or under active development. These include sensors that measure electronically upon binding of a chemical in the air shifts in resonance frequency, changes in electrical conductivity, changes in optical properties and changes in micro-mechanical properties. Of particular interest here are fully reversible micro or nanoarray sensors that can measure a number of different chemical or chemical components at the same time on a miniature low power electronic chip or nose. For this application the following sensor technologies are suitable: surface acoustic wave, quartz microbalance, micro electromechanical (MEMS) sensors, polymer arrays, metal oxide thin films, micro-optical sensors or other sensors. The underlying principles for these technologies and their applicability as chemical sensors have been extensively described in both the scientific and commercial literature and a number of these sensor technologies have started to become commercially available. For example the company Cyrano Sciences has started to sell its "Cyranose" technology based on polymer composites while BAE Systems has started to sell its "JCAD ChemSentry™" technology based on surface acoustic wave technology. Changes in conductivity is a particularly easy way to measure chemical binding and comparisons may be made with pre-stored reference tables or by more complex-on-the-fly statistical analyses such as Principal Component Analysis (PCA) or Neural Networks that then require varying degrees of microprocessing power. A "nose" type technology is particularly desirable for some complex chemical analyses of environmental hazards or chemical agents such as nerve gases.

In this application sensor module 16 may include either a permanent or long-term use micro or nanosensor array based on conductivity or resonance shift measurements or a disposable nose as described below. If a permanent sensor is used it is particularly desirable to use micro or sub-micro fabrication techniques onto stable surfaces such as ceramic, silicon or quartz. The following deposition or fabrication methods may be used: focused ion beam, atomic layer deposition (ALD), scanning tunneling, extreme ultraviolet (EUV) lithography or other ultra precise methods meant to manipulate single or groups of atoms.

The entire chemical sensor is small enough to be inserted into a mobile phone or even into a watch. Typically the sensor array would be smaller than 1 $cm^2$ in area and not exceed a few millimeters in depth. If sub-micron or nano fabrication methods are used for permanent sensors, the sensor array could be 1 $mm^2$ or smaller.

Since some types of chemical sensors are known to degrade over time and that portable personal devices such as mobile phones are typically used for several years, one embodiment includes the use of a new type of "disposable nose" technology. The disposable nose would be a very low cost, pre-packaged entity mainly made of plastics that would be widely available commercially and would be very easy to replace in a one step operation. The disposable nose further comprises multiple sensor or sensor arrays for detection of various chemical agents. If a sensor module is used, the disposable nose may form one detachable element of the module that could contain all the required remaining electronics components. Otherwise these components would be built directly into the personal device that would simply have a connection slot to receive the disposable nose. Such nose technology is provided by various industries including, but not limited to, Canberra and Smiths.

Figure 4:
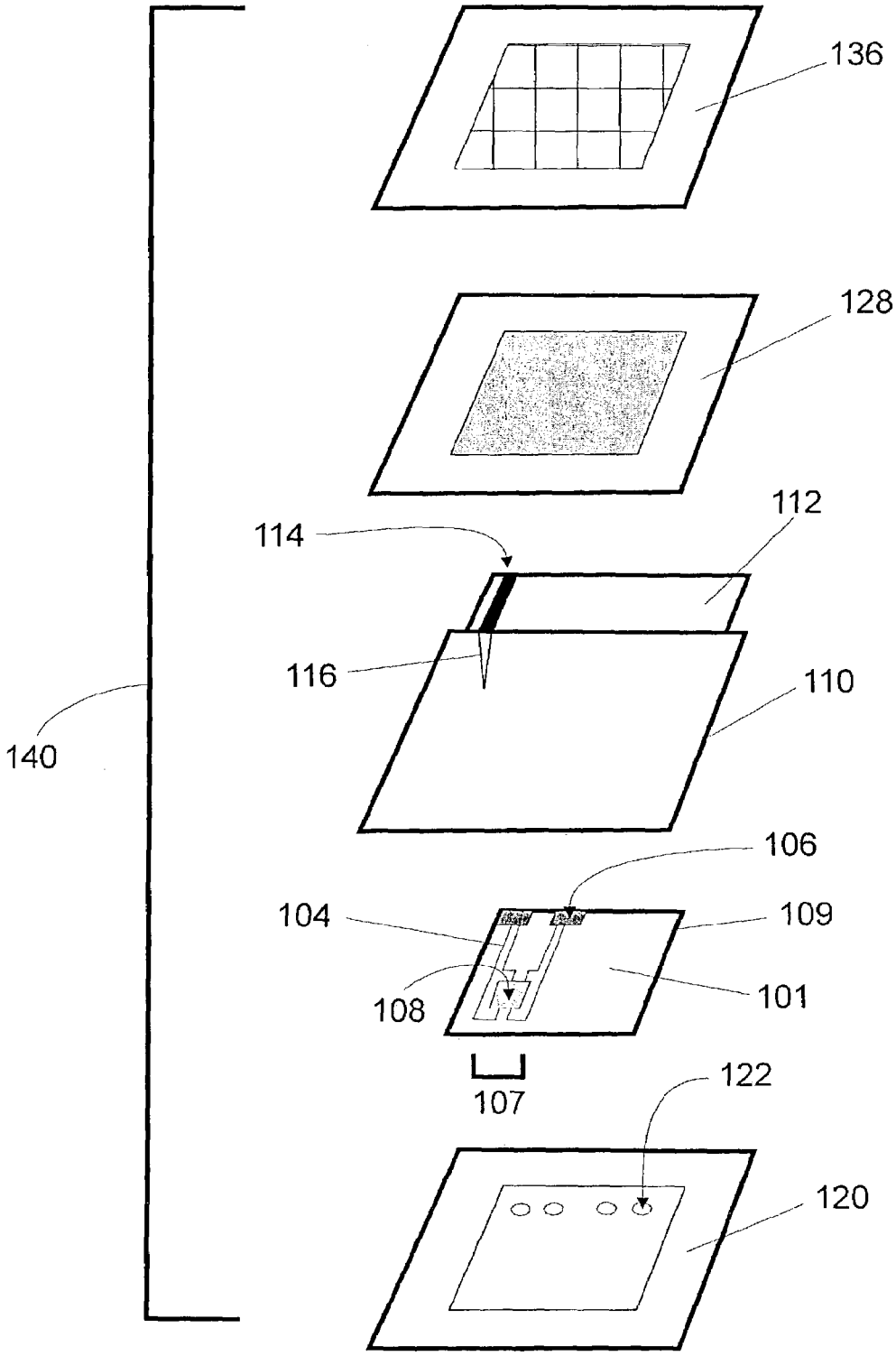
FIG. 4 is a perspective showing the internal elements of a disposable chemical nose used for the purposes of this invention.

Referring now to FIG. 4, a non-conductive substrate 101 is provided onto which is printed or deposited patterns 104 of certain conductive, semi-conductive and nonconductive materials such as certain doped inks or polymers. The polymers may include polyaniline, polybenzothiophene, polythiophene, regioregular poly(hexylthiophene), etc. The polymers may be doped either by oxidizing or by reducing by chemicals like iodine, arsenic pentachloride, iron(III) chloride, $NOPF_6$ and sodium naphthalide. New and stable inks or polymers doped with conductive nanoparticles that are suitable for direct printing may also be used and may be particularly desirable for some applications.

Substrate 101 may be either rigid (such as a silicon based material) or be flexible and may be made of a plastic such as polystyrene, polycarbonate, polyimide, acetate, etc. or commercially available plastic sheets meant to be used with commercial inkjet printers. A number of printing or deposition techniques such as inkjet, contact printing, stamping, screen printing and others are available and known to those skilled in the art.

In order to make the technology particularly cost effective and therefore disposable printing onto large sheets of soft flexible substrates such as plastic using standard inkjet or other newer printing technologies such as Flexographic printing may be particularly desirable using different types of doped inks, conjugated polymers or other chemicals that remain flexible, do not require high temperature curing and whose conductivity will change with the binding of certain chemicals.

Onto substrate 101 is printed or deposited precise geometric patterns 104 serving as conductive leads and using stable conductive inks or conductive polymers. The leads on one side form a larger connection area 106 and on the other side form one or several interspace areas 108 that allow the printing or deposition of certain polymers within those areas that then interconnect with the leads to form individual sensors. Multiple symmetrical patterns 104 are printed onto substrate 101 and typically each inter-space area contains a different polymer such that multiple individual chemical sensors 107 are made and form a complete sensor array or a nose 109. In addition multiple areas 108 may be included into each sensor element 107 allowing gradation or mixing of polymers or conductive inks within each individual sensor thereby further increasing the discrimination power of the entire sensor. Onto nose 109 is bound an electrical connection frame 110 typically made of a hard plastic such as Lexan polycarbonate and including an external electrical connection area 112 with multiple metallic or metallized plug-in leads 114, each of which is connected to a sharp pin 116 meant to pierce area 106 for each sensor element upon joining of elements 101 and 110 and thereby providing an external connection means. For the connection leads a metal plated with gold is particularly desirable. Other connection systems can be used and may include flat connectors (in lieu of pins 116) in combination with conductive glues or gels. In some applications, hardened conductive polymers may also be used, thereby decreasing even further the manufacturing costs.

Nose 109 is deposited onto a non-conductive basis or support 120 which may contain miniature wells 122 filled with conductive gels or glues. When frame 110 is mechanically bonded to the elements 109 and 120, each pin 116 pierces each corresponding connection area 106 to allow external connections for each individual sensor element. Gels or conductive inks in wells 122 ensure a stable and long-term electrical connection while helping seal the entire sensor unit.

Onto the unit composed of elements 110-109-120 is mounted a semipermeable vapor barrier 128 made of a material such as Gore-Tex® to protect the polymer sensor from possible exposure to water. Included into the support frame of vapor barrier 128 is a spacer (not shown) of sufficient height to allow vapors to flow freely in the inter-space thereby formed and to interact with sensor substrate 101. Onto the unit 128-110-109-120 is added a protective grid 136 with multiple holes and forming a sealed sensor unit 140. The entire unit 140 would be of a small size (typically around 1 $cm^2$), would be made mainly of plastics and would be prepackaged in a sealed low cost, widely available package that could be purchased everywhere very easily. For example the technology could become available at check out counters in food stores or pharmacies.

Nose 109 may include at least one of a conductive chemical component known to degrade with time when exposed to air more quickly than the other sensor elements and serving as a counter to warn the user when it is time to replace the nose of the sensor module or cartridge. In addition the nose may include a humidity sensor made of a hygroscopic material to measure the amount of moisture present in the air. Since the conductivity of the polymers may change with time and with humidity levels, reference tables may change according to the changes in the values of the counter and the hygrometer. Methods used for the fabrication, measurement and calibration of polymer noses and polymer electrical circuits are known to those skilled in the art and are included herein.

The purpose of this given embodiment is to provide a means for the fabrication and use of a complex miniature chemical sensor that could be used very broadly and replaced a regular intervals in a very low cost in one-step "plug and play" package.

The disposable nose technology is specifically meant to complement a long-term use electronic personal device such as a mobile phone or PDA. The use of this technology allows for long-term, low cost, multiple chemical threat detection applications including the detection of sarin, soman, VX, hydrogen cyanide, etc. The technology would also include applications for the long-term detection of person-specific external chemical hazards having a negative impact on a given person because of his or her unique medical needs and as first described in U.S. Pat. No. 6,031,454.

In some applications a simpler pre-calibrated integrated single chemical sensor element may be desirable for insertion into the sensor module or built directly into the device and could be based on technologies other than conductive polymers. Reference is made for instance to single chemical sensors made by companies such as Figaro Engineering Inc. or OMRON.

Anthrax Detector on a Chip

Miniature biological agent sensors on a chip are currently the focus of intense research and development efforts. Of particular interest for this given application are miniature sensors on dry chips for the detection of major biological threats like anthrax spores in the air and based on surface electrochemical measurements. This type of technology is still under active development although reference is made herein to the Bio-Alloy™ sensor technology from the IatroQuest Corporation.

In one preferred embodiment a new type of miniature biological sensor on a dry chip is provided that can specifically detect anthrax spores in the air. Anthrax spores present a particular problem because the weaponized form is coated with certain chemicals that make the spores not recognizable by liquid-based detection systems that are based on antibodies or on the shapes of individual proteins present on the external envelope or coat of the organism. Hence the only way currently to detect anthrax with certainty is to break the spores apart and use sophisticated DNA methods.

Figure 5A:
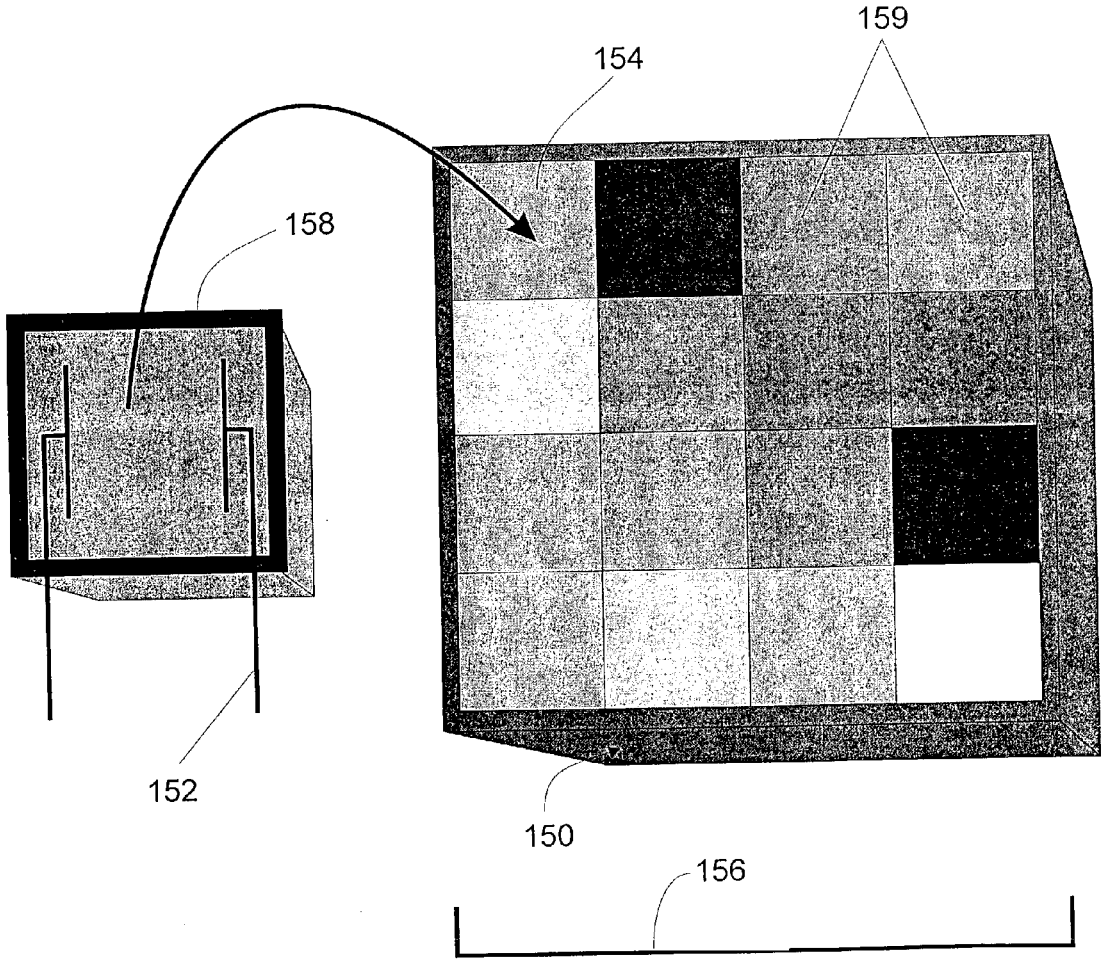
FIG. 5A is a perspective diagram showing a multi-surfaced array forming the first component of an electronic anthrax detector on a dry chip.

The technology makes use of the following two principles in combination. The first is the known ability of small particles to be attracted or repelled by certain surfaces due to the electrostatic and chemical surfaces properties of said surfaces. Hence in a first dimension and referring now to FIG. 5A, an ultra flat chemically stable and non-conductive surface 150 such as crystalline silicon, glass or a certain ceramics is provided on a small chip (typically of 1 $cm^2$ or smaller). Onto surface are deposited individual electrodes 152 with external connections or leads (not shown). The electrodes are embedded into non-conductive surface 150 using standard lithographical techniques. Chemically different individual grids 154 are subsequently vapor deposited using masks onto surface 150 forming a stable and permanent array 156 of different chemical surfaces 159. For vapor deposition techniques such as pulsed laser deposition, sputtering or atomic layer chemical vapor deposition may be suitable. Typically each surface is only a few hundred to a few thousand atoms thick.

The resulting array has a few tens or even a few hundred permanent grids 154 that are identical in size but different in chemical surface composition. Each grid is electrically isolated from its neighbor by a separation area or space 158 that may be a trench or wall of a stable element such as silicon. Any type of chemical may be used for the fabrication of individual grids 154 provided that they have the following three characteristics: 1) are chemically stable and not subject to extensive atomic migration 2) are of a chemical composition known to have varying degrees of electrostatic attraction for each of the known coatings that are possible for weaponized anthrax spores (going from strong positive to strong negative), and 3) having some degree of electrical conductivity.

Figure 5B:
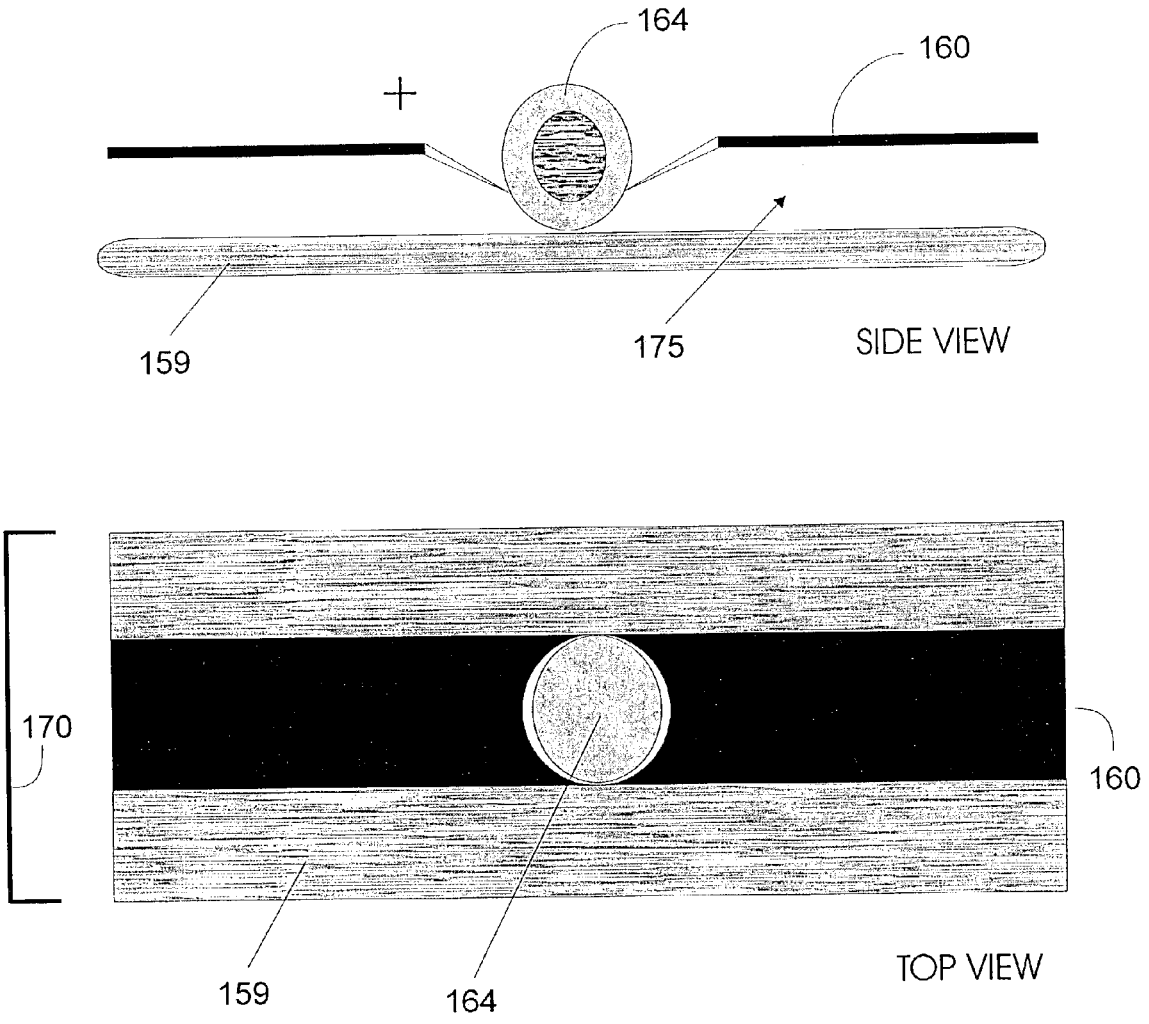
FIG. 5B is a side and a top perspective for a second component of an electronic anthrax detector on a dry chip.

In a second dimension and referring now to FIG. 5B, a matrix of precisely fabricated conductive microelectrodes 160 is provided. The microelectrodes are of a size and specific shape to allow a spore of anthrax 164 to fit precisely within the electrodes (with an opening typically between 1 and 5 microns) so as to provide a means to generate precise electrical measurement of the properties of the particles that fit within the electrodes. A speck of dust having exactly the same dimensions as an anthrax spore would not have the same conductivity and electronic signature as an anthrax spore. Electrodes 160 form grid patterns that precisely cover the same surface areas as the individual grids 154 of unit 156 and forming a separate unit 170. The electrodes 160 may vary in size in each given grid or be of the same size.

Dimensions one and dimension two are then combined into a single chip with sufficient spacing 175 to ensure that electrodes 160 do not come in contact with surfaces 159 by using for example an electrically inert spacer (not shown). Various fabrication methods may be used. The two surfaces 156 and 170 may be fabricated first as two individual chips that are then combined by precisely overlay using an ultra precise die bonding machine. Other alternatives are to build the chip in successive layers or to build the two units side by side. A most preferred embodiment is to combine the two layers one on top of the other and resulting in a single electronic chip that provides two orders of discrimination and analyses. The entire chip may be included in a replaceable sensor module and is protected by a grid (not shown) with openings typically between 20 and 100 $\mu^2$ to allow single anthrax spores to flow freely in and out of the sensor area but keeping larger particles away.

Electrical signatures are then measured and statistical discrimination measures are provided by an external microprocessor (not shown). The first order of discrimination is the time of retention and attractiveness of particles in each given grid compared to the next one. The second order of discrimination is the electrical conductivity measurements of the particles within the grids. Because two orders of measurements and discrimination are provided the technology is conducive to calibration with powerful statistical discrimination tools such as Principal Component Analysis (PCA), Canonical Variate Analysis (CVA) or Neural Network Analysis. In addition the technology is fully reversible and is therefore very similar to the polymer "nose" technologies. Reference is made to the statistical methods and various compression algorithms used for chemical nose technologies that are well known in the art.

The difference is that this given technology is built to specifically detect biological hazards in the air and is specifically meant to be small enough to be included in a small personal device such as a mobile phone. In addition the technology allows the instant cleaning of the sensor by periodically and automatically reversing the polarities on the surfaces using electrodes 152 and 160.

A preferred embodiment for this given sensor technology is that this miniature anthrax detector on a chip is included in a small personal device as a mobile phone in order to be used for wide area surveillance of a terrorist threat such as a planned release of anthrax spores. The use of this technology and the elimination of false positives would be similar to the procedures and methods described below for radiation.

Combined Sensors on a Chip

The above sensor technologies are potentially so small that they could be combined providing radiation, chemical and biological detection capabilities on a single dry electronic chip, forming yet another embodiment of the present technology. In the case the three technologies are combined, conventional or advanced lithographical techniques would be used on a silicon basis and would be complemented with other ultra precise deposition or atom removal methods. The components for the radiation and biological sensor would be similar to those described above. However for the chemical sensor smaller more permanent sensor technologies would be used such as quartz microbalance, micro or nano conductive surface sensors, etc.

It should be appreciated that a combined radiation and chemical detection microchip can be fabricated on the same microchip using doped micro or nanowires or doped nanotubes. Indeed doping will change the properties and conductivity of such nanowires or nanotubes. In the case of chemicals, specific binding with the doping molecules will change the conductivity or electron tunneling. In the case of radiation similar changes can be expected with the use of certain metals, as described above. Hence a dual radiation chemical sensor technology is particularly simple and desirable for the applications of this invention. This sensor may be included in the sensor module or built directly into the device.

In addition to the above applications, by using advanced micro and nano fabrication technologies, a single "Homeland Security" chip may be built that includes on a single chip the functions of wireless communication, geo-location and external threat detection for chemical, radiological and biological hazards or a combination thereof. Such a Homeland Security chip may be mass produced and become commercially available for broad distribution and integration into personal devices or even into any electronic device, thereby providing yet another means for wide area detection of terrorist threats within a given country. A single "Homeland Security" chip may be provided by various technology industries including, but not limited to, Intel®.

Use of Embedded Passives as Sensors

Embedded Passives (EP) are rapidly emerging as important technology in printed circuit fabrication since they can be screen-printed and can serve as resistors, capacitors and inductors, thereby decreasing the cost and size of circuit boards. The technology can be used to make mobile phone components. Reference is made for example to the disposable phone made by Dieceland Technologies.

In the present application and forming another embodiment it is contemplated that mobile phone or PDA circuit assembly may include Embedded Passives technology and in particular surface-exposed Embedded Passives using different types of polymers and serving as chemical gas sensors thereby providing dual use technology without any addition of size or cost, two important considerations for mobile phone technology.

Creating specific surface-exposed Embedded Passives serving as gas sensors directly as part of the mobile phone electronic assembly may have certain advantages for some applications of the present technology. For example for some passive low cost monitoring applications the only area of the mobile phone board that would be active would be the sensor area. If a hazard is detected then the entire mobile phone circuitry would be activated, creating heat and thereby reversing the sensor reaction.

Person-specific Hazard Detector Technology

In another embodiment, the disposable nose technology described above used in combination with a personal electronic device such as a mobile phone, PDA, modified pager or modified watch that includes logic, storage and microprocessing capabilities allows the building libraries of sensor values that are person-specific.

For example if a person has a specific chemical allergy or multiple chemical allergies or suffers from asthma, the technology described here can be used to "train" the disposable nose to recognize only certain chemical components that represent a hazard to a specific person.

Rather than pre-calibrating the nose what would happen would be the following. Each time a person suffers from an adverse reaction to external chemicals or has an asthma attack he or she would activate a user interface, such as pressing a special button on the modified personal device, to relay a signal to the microprocessor and the memory of the electronic device. The electrical values of each of the sensor elements of the nose at that given time would then be stored in memory and over time a person-specific library of values would be recorded into the device. Once these values are recorded they can compared, merged and then be used as person-specific references to warn the person that he or she is entering an environment that contains chemicals that are likely to cause an adverse health reaction.

Additionally and forming yet another embodiment each time a given person suffers from an allergic or asthma reaction, the sensor values may also be relayed over the networks to a secure database. The stored values on the remote database can then be used to characterize precise person-specific chemical allergens and thereby custom-tailor person-specific drug treatments for asthma or chemical allergy sufferers. The two way wireless link could also be used to automatically upload software into the device such that it would recognize in the future the person-specific hazards and warn said person.

This given technology and method is important since a large number of people worldwide suffer from chemical allergies but it is very difficult to pre-assess exactly what chemical components cause these adverse reactions and how these change from person to person.

This given technology may be included within a sensor module, may be build as part of the modified personal device with a simple slot to receive only the disposable nose (and where the remaining electronics are built within the device) or both the sensor components and the associated electronics may be built directly into the personal device if a long-term multiple chemical sensor chip is used. With sub-micron fabrication methods this given technology and method of detection could even be included into watches.

Mobile Phone with Build in Radiation Microsensors

Many electronic components within mobile phones typically can serve as references or measuring devices for radiation events since microelectronic components and in particular small logic gates are known to be sensitive to ionizing and particle radiation. Because of this some microelectronic components are now "hardened" to be insensitive to radiation. However in this application the idea is to make some components within phones specifically excellent measuring devices for external threats like radiation. This technology is important in that it can contribute to global or wide area surveillance efforts by directly allowing individual members of the public to contribute to a national threat surveillance effort. Furthermore having a measuring device built-into a personal device such as a mobile phone allows people to make multiple uses of their mobile phones, an important economic incentive for cell phone manufacturers.

The mobile phone and threat assessment technology may include antitampering features for some security applications and may allow transparent dial in into the surveillance networks, as described below.

Assuming that such monitoring capabilities are directly built in mobile phones and that this capability is either mandated by Governments or by organizations such as the FCC in the United States or is voluntarily adopted by mobile phone manufacturers who realize the benefit of providing such new dual use technology to its consumers (either as a swappable sensor module or a built-in component), the following scenarios can be envisioned.

Figure 6:
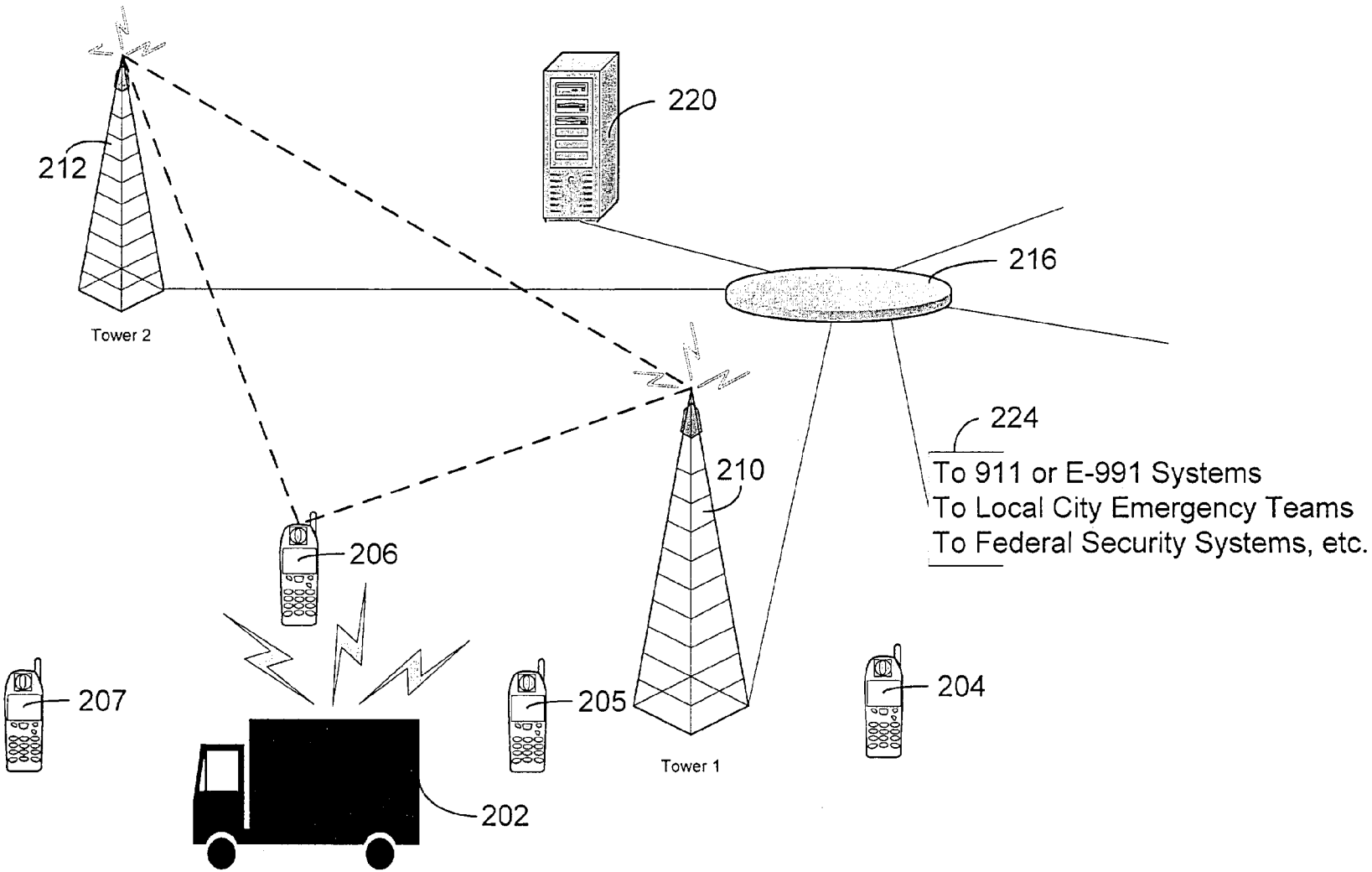
FIG. 6 is a diagram illustrating the use of modified mobile phones carried by members of the public in response to the presence of a potential hazard such as a dirty bomb hidden within a truck.

Referring now to FIG. 6 a truck 202 carrying a device such as a "dirty bomb" or an atomic weapon emits a high level of radiation (typically gamma, neutron and x-rays) from a source of cesium 137, cobalt 60, uranium or other radioactive materials with strong signatures. Truck 202 travels along a path and encounters in close proximity and in rapid succession a number of modified mobile phones 204, 205, 206 and 207 for example by driving next to cars with passengers equipped with such phones. Phone 206, which is closest to truck 202, picks up an abnormal level of radiation, automatically and transparently activates the phone that then dials into the cellular network according to a pre-programmed instructions stored in memory. In an alternative design and configuration, the user is informed first as shown in 48 and then has the option to call 911 or other emergency numbers. In that alternative software may be included in the mobile phone to give the user emergency voice or screen instructions as well as dial-in options. The user can judge for him or herself if the truck looks suspicious and give a detailed description of the truck, location and driver to the police. If swappable sensor modules are used, individual modules may include the software with the instructions to the user and/or the network.

In order for the technology to be widely adopted by the public, it is important to allow each individual user to self-decide if he or she wants to participate in the global surveillance effort and have the option either to turn automatic notification on, set the phone to manual, or not use the sensor capabilities at all.

If the automated transparent system is used geolocation can be provided by two separate means. If a GPS chip is already present in the device the GPS coordinates are provided to the network, along with other key information. If the phone is not equipped with a GPS chip, the E911 system is used and land-based triangulation is activated between the two closest towers 210 and 212 and the mobile phone. This information is relayed to a network computer 220 that records and monitors the events according to pre-set instructions. In rapid succession phones 204, 205, 206 and 207 (or alternatively multiple users) will relay the same information, indicating not only the path taken by truck 202 but also serving as a means to eliminate false positive events. Specialized computer algorithms may be developed to help with the elimination of false positives. In this instance for example a Bayesian approach may be utilized and be particularly useful.

Computer 220 and/or E911 operators then convey the information to the relevant emergency systems as indicated in 224 via link 216 which may be the Internet, dedicated phone or T1 lines, wireless links, optical fiber, satellite links or a combination thereof. Typically emergency information would be relayed to local police or to rapid response teams or to the Federal emergency systems that are either in place or being put in place as a response to the Homeland Security initiative in the US.

Figure 7:
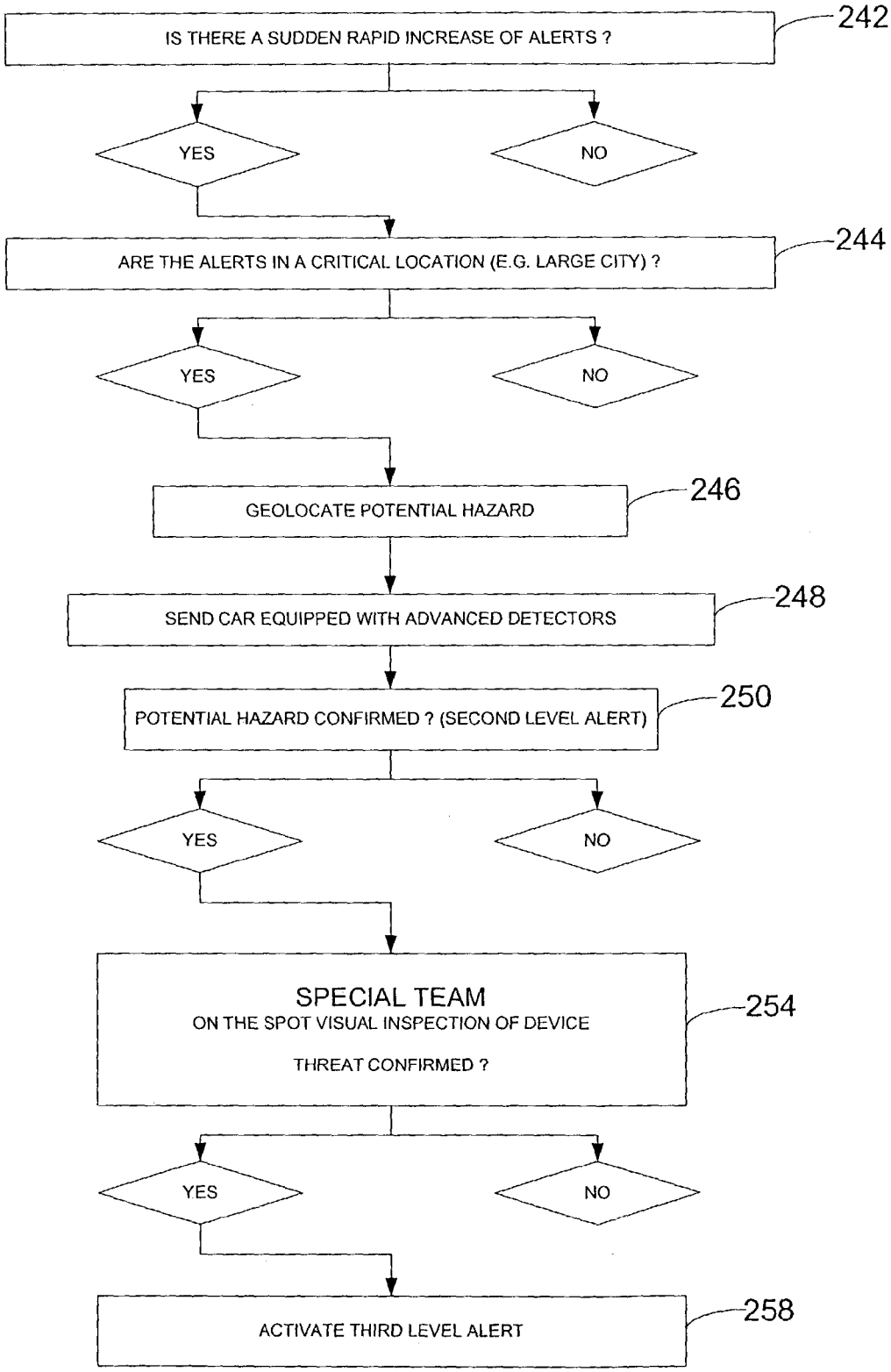
FIG. 7 illustrates how responses to a potential terrorist threat can be rapidly activated with three successive control and alert levels.

Referring now to FIG. 7 the following software and decision paths and alert levels can be taken. First the network determines if there is a sudden increase of alerts 242 coming from the same overall area but from a number of different mobile phones. This is the first level alert. Next the level of criticality of the potential threat is determined by its precise location (e.g. a large city) as indicated in 244. Information on the precise location of the threat is then calculated within a few meters and this information is converted to GPS coordinates and/or to precise map coordinates (street names, etc.). This information is then relayed to a special emergency team (e.g. a police car equipped with highly sensitive detectors) as indicated in 248.

The coordinates of the special car are matched with the coordinates of the potential threat allowing the precise identification of the truck or car carrying the potential dirty bomb. If the highly sensitive detectors in the special car confirms the potential hazard 250, this triggers the second level alert and several options can be taken. One of them is to stop the suspicious vehicle and send in a special team 254 which can then visually inspect the threat. If the threat is confirmed a high level alert 258 can be activated (evacuation of the area, etc.). A number of highly sensitive remote radiation detectors suitable for mounting into special cars are available such as the Cryo3 (jointly developed by Lawrence Livermore, Los Alamos and Lawrence Berkeley National Laboratories) or the SAM 935 from Berkeley Nucleonics.

Using the above method and apparatus provides a stepwise approach that not only maximizes the chances of detection of a rare threat event and provides for a means to eliminate false positives but also minimizes the overall costs by using existing networks and systems. As indicated above a key feature is that the system is extremely flexible and that it can be automated by the addition of specialized Bayesian software such as the one already prototyped by Lawrence Livermore National Laboratory for its Wide-Area Tracking System (WATS).

The above description was limited to radiation but a similar approach can be taken for poisonous nerve gases or even for bioterrorism. Indeed, as shown in this application, the rapid progress in microchip fabrication now allows the detection of agents such as anthrax spores on miniature dry chips. Such sensors can be included into small personal devices carried by people including mobile phones. As indicated above, by using probability analyses, both internal and external to the device and by using the network protocols described here, multiple events can be quickly detected, pinpointed and confirmed by visual inspection and/or the use of more expensive detector technologies. In the case of either a potential dirty bomb or a release of anthrax this stepwise detection method allows for the elimination of false positives at very low cost. This given technology could therefore help save a large number of lives and avoid an economic disaster. The technology described here is specifically meant to be of the lowest possible cost because it would use many already existing components to provide an effective method for wide area surveillance.

While a completely automated system has been described, the detection of a major threat such as a dirty bomb or an anthrax release may still be best accomplished directly and manually by the people equipped with modified mobile phones. Indeed and referring to FIG. 6 by coming into close proximity of truck 202 and being warned by mobile phone 206, the bearer of the phone may get close to and then away from the truck several times. If the sensor is activated and then deactivated several times this would confirm the likely presence of a radioactive source in the truck. A that time a precise description of the truck, the driver and the location of the truck can then be manually called into the 911 system and the police can then rapidly stop and inspect the truck.

Modular Universal Detector

In an alternative design and in another embodiment, the wide area surveillance technology described here and first described in U.S. Pat. No. 6,031,454 is modified and is based in part on cell phone technology as described below. The technology in this given embodiment is more tailored to individual industry components such as segments of the transportation industry. Again the emphasis is on providing a very low cost solution that can be widely deployed to maximize the chances of detection of a major threat. Transportation industries may include, but are not limited to, FEDEX™, UPS™, and other various transportation and carrier industries.

Rather than building a sensor directly into a mobile phone, PDA or watch or providing a new type of personal device with a slot to insert a sensor cartridge, a flexible, programmable and completely modular device is provided that has the following characteristics:

Being able to connect directly to any pre-calibrated sensor, sensor device or sensor module Being able to link to any type of remote network via a wireless link Being of a rugged design to be added into trucks, shipping containers, buses, etc.

Having a very low power consumption

Figure 8:
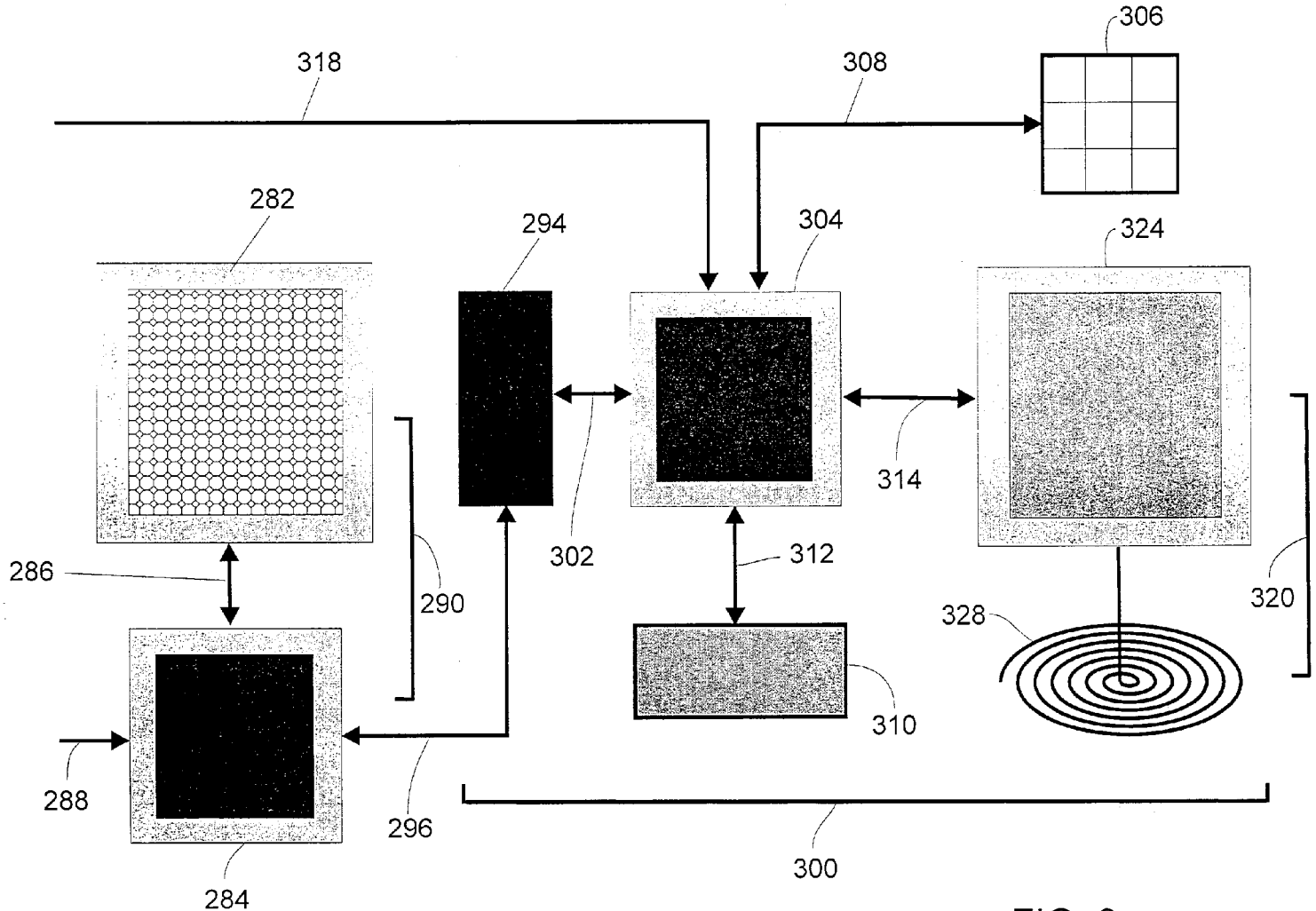
FIG. 8 is a block diagram of a modular wireless detector with a universal interface to detect remotely the presence of a chemical, radiological or biological threat.

Not imposing the burden of any monthly network fees on the owner until the system is activated by a potential emergency Being of very low cost and of a small size Referring now to FIG. 8, a sensor or sensor array 282 controlled by a microcontroller 284 continuously monitors a given external hazard. Microcontroller 284 and sensor 282 are connected 286 and form an autonomous unit that may include an external power supply 288. Microcontroller 284 has stored reference values for sensor 282 and can be programmed to set alarms for certain thresholds. All the necessary electronic components (analog-digital converter, etc.) are not shown in FIG. 8 for the sake of clarity and are well known to those skilled in the art.

The devices 282 and 284 form a self-contained unit 290 that may be any type of commercial "off the shelf" or COTS sensor unit such as a pre-calibrated radiation monitor. Reference is made for example to Siemens Electronic Personal Dosemeter (EPD) and Siemens Neutron Electronic Personal Dosemeter (EPD-N) used by NATO. For chemicals a number of COTS technologies and sensors are also available such as the "Cyranose" made by Cyrano Sciences. For biological agents fewer COTS sensors are currently available although a modification of the HANNA detector made by Lawrence Livermore National Laboratory may be suitable in some applications. Additionally any of the individual sensors described above may be used as a basis for the sensor element 282.

An interface 294 is provided to receive a signal from unit 290, for example the signal from a built-in alarm via connection 296. Interface 294 may be a simple plug in connector that may include a voltage corrector (not shown) to reduce or amplify the signal from unit 290. Interface 294 may also include a miniature relay or similar means to turn on the unit as described below. The purpose of interface 294 is to allow connection to any type of sensor module interchangeably, thereby allowing complete flexibility in the choice of detector technologies.

Interface 294 forms a part of a self-contained programmable modular communication unit 300 that includes the following components.

A programmable microcontroller 304 connected to interface 294 via link 302. Microcontroller 304 includes a miniature keypad 306 that allows the easy input and storage of a given dial-in number by an external user. Such numbers may include 911, the security system of a given company, a fax number or a dial in number to a system connected to the Internet. Keypad 306 is connected to microcontroller 304 via link 308.

Microcontroller 304 is also connected to an interface 310 via link 312. Interface 310 allows great flexibility of user input. For example the interface may be a recordable chip which would allow the user to record his or her own message such as: "This is truck number XXX from fleet XXX. A potential hazard has been detected in this truck. Please notify police immediately". Alternatively a message can be downloaded electronically to unit 310 which could then be a chip destined to communicate via fax or e-mail to a given security office. Another alternative is a pre-recorded message with electronic security codes and passwords destined to Internet-based systems or to secure servers. Unit 310 also allows the programming of microcontroller 304 and the storage of all the necessary handshake and/or security protocols to allow access to a given network or security system.

Microcontroller 304 is connected via link 314 to a communications unit 320 comprising a communication chip 324 and a send/receive antenna 328. Microcontroller 304 is supplied by a power connection 318 that supplies the entire unit 300 and may also supply the unit 290 via link 302 and 296.

For maximum flexibility, particularly when an external power supply is available, microcontroller 304 preferably includes programmable internal components of logic, processor and memory and reference is made for example to the CoolRunner™ chip from the Xilinx Corporation. Depending on the sensor applications and the presence of unit 284, microcontroller 304 may include more extensive processing means and may include an external storage unit (not shown). If a Field Programmable Gate Array (FPGA) is used, processing software such as MicroBlaze made by the Xilinx Corporation may be used to easily and conveniently program the unit.

Low Cost Security Network

In a preferred embodiment the "pay as you use" technology is used to allow the user to avoid monthly fees. This new technology basically allows the pre-payment of a certain number of communication minutes or units on the networks. This given technology is used for example by the Hop-On Corporation and is the ideal type of system to use here since the communication system is designed to be off until it activated by a rare event or until it is activated remotely (for example to check remotely on the contents of a truck). It should also be noted that 911 or E911 calls in the US are free calls as mandated by the FCC and must be carried even by mobile phones that are no longer activated. The use of this given system therefore is another way to eliminate monthly fees and reduce costs.

Figure 9:
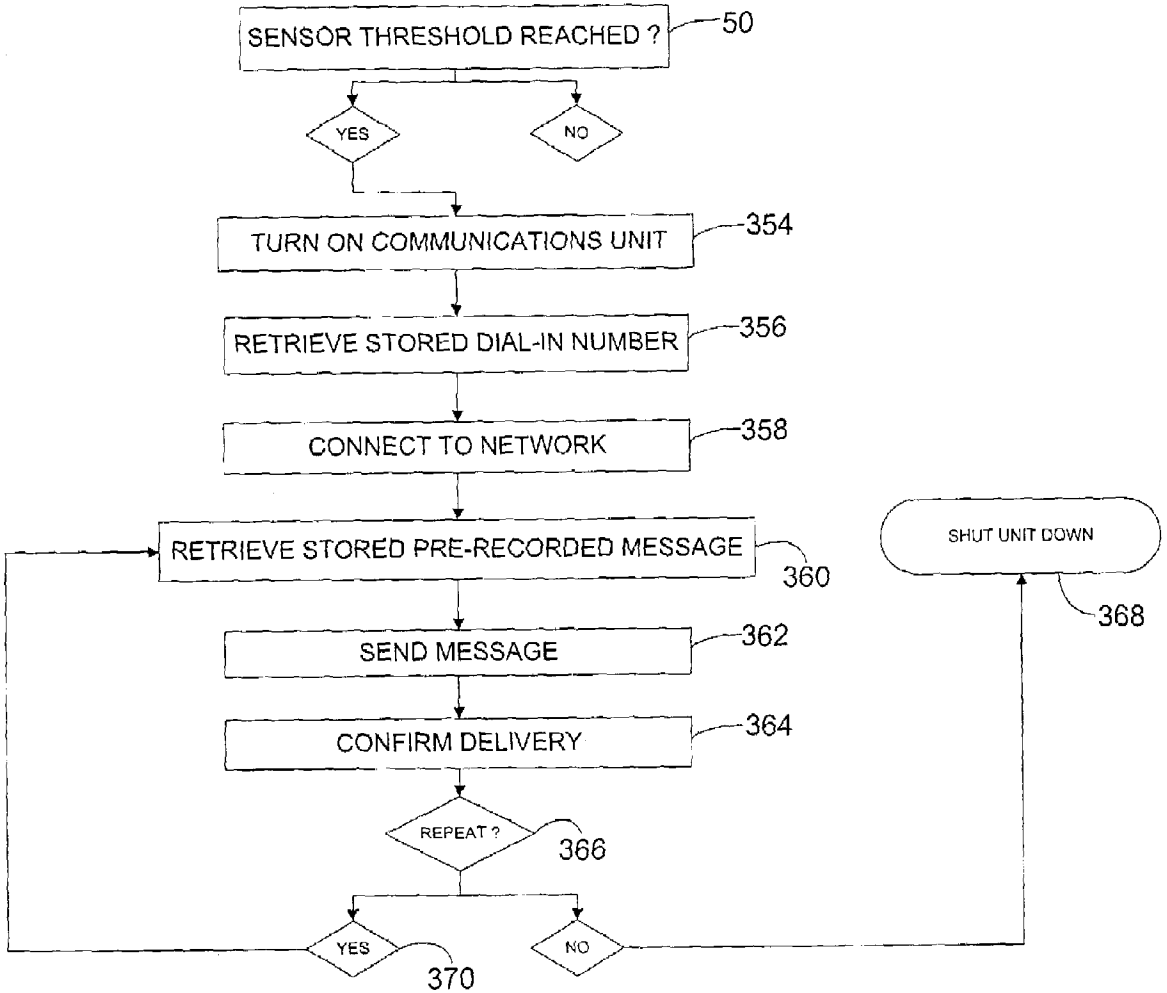
FIG. 9 is a diagram for a preferred electronic pathway for the modular detector described in FIG. 8.

Referring now to FIG. 9 if a pre-set threshold 50 is reached microcontroller 284 sends a signal to microcontroller 304 that then turns on unit 300 via signal 354. An alternative design is that interface 294 may include an "off/on" miniature relay (not shown) or other device to turn on unit 300 and minimize power consumption. The power for the relay or the on/off switch capabilities would be provided either from unit 290 or unit 300. The purpose of this is to minimize power consumption. Sensor unit 290, particularly if it has a micro and nanosensor, may be of extremely low power consumption. Because the communication module is only turned on when necessary the entire unit can run for a long time on a small high capacity battery. This battery may be rechargeable by link 288 that may be connected to the power supply of the truck, train or transportation system using the device.

As described in U.S. Pat. No. 6,031,454, and incorporated herein by reference, the communication unit or system may also be turned on remotely to check for example a given sensor value and a variety of different designs are possible.

Microcontroller 304 then retrieves the pre-stored dial in number or codes 356, activates unit 320 by powering chip 324 and antenna 328. Connection is then established as indicated in 358 and microcontroller 304 retrieves the pre-recorded message in unit 310, then sends the message as indicated in 362. The various "handshake" protocols are stored in unit 310 and delivery is confirmed as indicated in 364. A possible repeat loop 366 is included and the pre-programmed unit has the option either to shut down as indicated in 368 or repeat the message as indicated in loop 370 (which would then include a counter to prevent an endless loop).

The device described in FIG. 8 is completely self-contained and is meant to be mounted within trucks, buses, containers, etc. The entire unit is typically rugged and built to withstand heat, vibration, etc. The device may also be sealed to prevent anti-tampering and may include anti-tampering technologies (such as a turn on notification with a special message if the unit is dismounted or disconnected). The entire unit is very small (typically the size of a cigarette pack) and can easily be concealed within the body of a truck, bus or transportation system.

Using COTS components, emerging microchip radiation sensors for neutrons and the detection and fabrication methods described here, a miniature remote sensor for the wide area detection of dirty bombs could be built for less than US $100, thereby allowing the technology to be deployed very widely.

It will be appreciated that many different types of designs are possible for FIGS. 8 and 9 that illustrate the overall principles of this invention.

Figure 10:
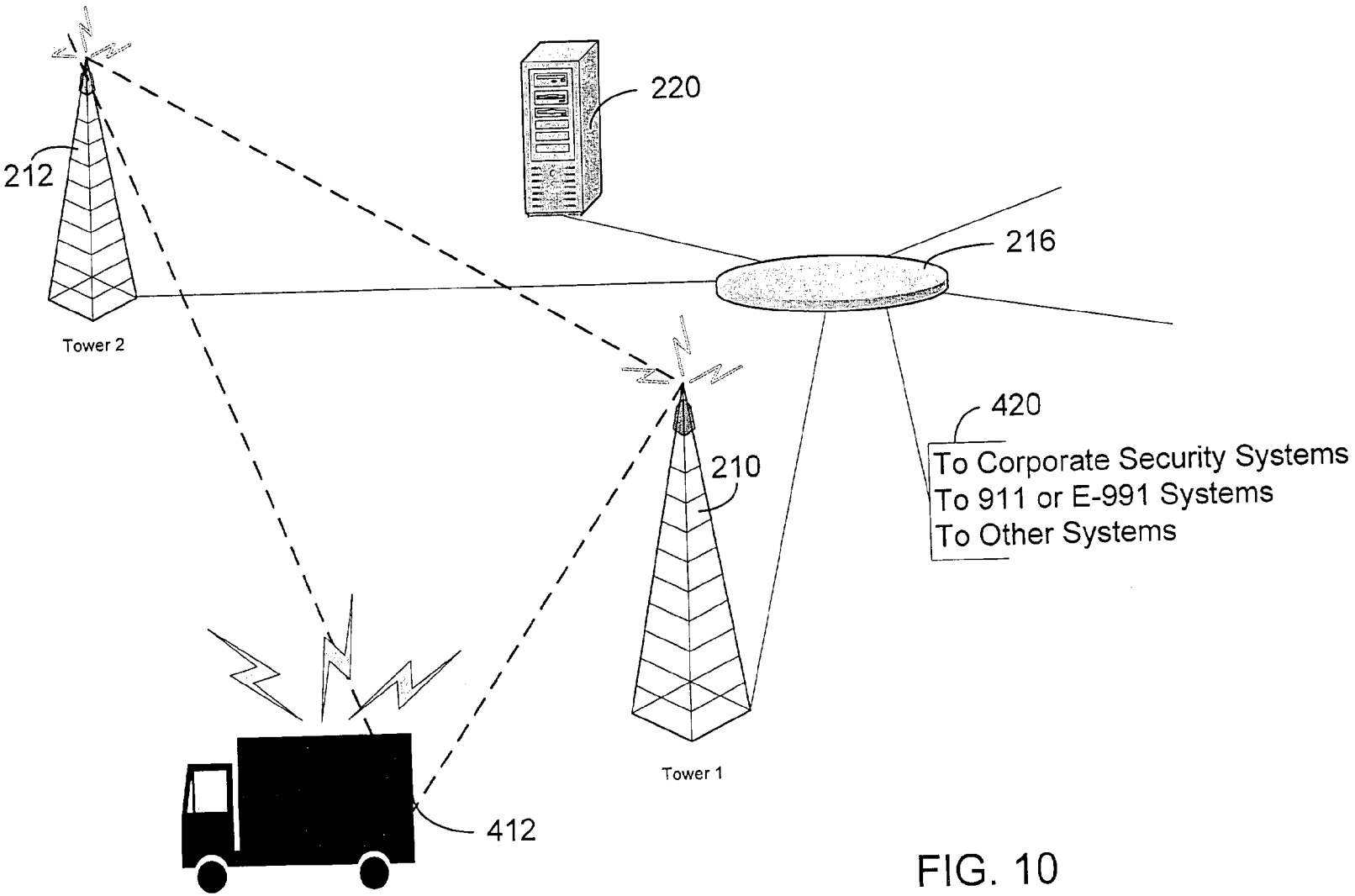
FIG. 10 illustrates how a truck containing the modular electronic detector will be identified and located as soon as the potential threat or hazard is loaded onto the truck.

Referring now to FIG. 10, a truck 412 or a container equipped with the self-contained device loads a parcel containing for example a source of ionizing radiation or another potential hazard that normally should not be present. This then activates the communication unit 300, the truck is geolocated either via GPS, triangulation technology or by directly contacting the driver and/or the corporation owning the truck that can then rapidly be inspected. In this particular embodiment the communication 420 via network 216 is most preferably routed to an internal security system operated for the company owning the truck or transportation system. The company then can decide what action is required next. For example the driver of the truck can be notified and requested to stop (or leave immediately a densely populated area). If a genuine high level threat is suspected the security manager or system can then immediately transfer the information to the police or to Federal security systems being installed as part of the Homeland Security initiative.

While the invention has been described with respect to specific embodiments for complete and clear disclosures, the appended claims are not to be thus limited but are to be construed as embodying all modifications and alternative constructions that may occur to one skilled in the art which fairly fall within the basic teaching here set forth.

What is claimed is:

1. A personal wireless device with a unique electronic ID or signature, the device being typically carried by or used on a regular basis by a user, the device comprising:

a transceiver for telecommunications functionality, said transceiver being capable of communicating with a network;

said wireless device defining a slot adapted to receive an interchangeable sensor module;

an optional interchangeable sensor module adapted to be received in said slot;

said interchangeable sensor module having at least one sensor associated therewith, said at least one sensor having the capability of detecting, identifying and quantifying the level of at least one of a plurality of hazardous agents in an area surrounding said sensor module;

said sensor module further having a unique electronic ID for identifying the type of said sensor module;

said wireless device having an interrogator function for reading the electronic ID of said interchangeable sensor;

said sensor module being in intermittent communication with a data storage device;

said wireless device having a user interface for said user to direct said wireless device to communicate the identity and level of at least one said hazardous agent detected by said sensor module at a specific point in time to said data storage device;

said wireless device further having a notification alert function responsive to said sensor module for emitting an alert that the sensor has detected the level of at least one hazardous agent which said user has stored in said data storage device at said specific point in time;

said wireless device having a microprocessor or microcontroller for controlling the transceiver, the sensor module, the user interface and the notification alert function; and said wireless device having the capability of sending said notification signal to remote receivers through said network via said transceiver.

2. The personal wireless device as claimed in claim 1 wherein the wireless device is a modified mobile phone.

3. The personal wireless device as claimed in claim 1 wherein the mobile phone is disposable.

4. The personal wireless device as claimed in claim 1 wherein the wireless device is a modified Personal Digital Assistant.

5. The personal wireless device as claimed in claim 1 wherein the wireless device is a modified two-way pager.

6. The personal wireless device as claimed in claim 1 wherein the wireless device is a modified watch.

7. The personal wireless device as claimed in claim 1 wherein the device has a unique signature ID that can be identified via the network.

8. The personal wireless device as claimed in claim 1 further comprising a geo-positioning means for determining the location of the user.

9. The personal wireless device as claimed in claim 1 wherein the geo-positioning means is based on triangulation technology.

10. The personal wireless device as claimed in claim 9 wherein the geo-positioning means is internal to the personal wireless device.

11. The personal wireless device as claimed in claim 10 wherein the geo-positioning means is based on geo-stationary satellites and the wireless device further includes global position satellite (GPS) means.

12. The personal wireless device as claimed in claim 9 wherein the geo-positioning means are external to the personal wireless device.

13. The personal wireless device as claimed in claim 12 wherein the geo-positioning means are based on a land-based transmission system.

14. The personal wireless device as claimed in claim 1 wherein the sensor module includes sensors selected from the group consisting of radiation sensors, chemical sensors, biological sensors and combinations thereof.

15. The personal wireless device as claimed in claim 14 wherein the sensor module further comprises one or more microsensors, microsensor arrays, or nanosensors.

16. The personal wireless device as claimed in claim 14 wherein the sensor module is able to detect at least one of the hazardous agents selected from the group consisting of chemical agents, radiological agents, biological agents and combinations thereof.

17. The personal wireless device as claimed in claim 14 wherein the sensor module further includes an integrated circuit having an integrated measurement and control device for the at least one hazardous agent.

18. The personal wireless device as claimed in claim 14 wherein the sensor module comprises a radiation sensor that can detect the level of radiation present in the area surrounding the wireless device.

19. The personal wireless device as claimed in claim 18 wherein the personal device further comprises:

a programmable means for storing and recognizing a given radiation signature as a threat to human health;

a means to manually select a function of notification, wherein the signal for notification is selected from the group consisting of an automated dial-in of said threat to an external programmable number via a wireless link which provides step-by-step screen or voice instructions, telephone numbers and an audible warning to the user relating to the presence of the threat and combinations thereof.

20. The personal wireless device as claimed in claim 18 wherein the radiation sensor further comprises:

a sensor having at least two microdevices, wherein at least one microdevice is sensitive and at least one microdevice is insensitive to the presence of a radiological agent;

a shielding material, wherein the shielding material is provided on select sensor components;

and means to compare electrical outputs provided by the microdevices, the sensor tailored to recognize specific types of radiation through microdevice detection levels.

21. The personal wireless device as claimed in claim 20 wherein the microdevices include at least two clocks having doped and undoped crystals, wherein the microdevice detection levels are provided by specific doping of the doped crystals.

22. The personal wireless device as claimed in claim 18 wherein the radiation sensor further includes a diode which serves the dual function of capture and measurement of an external neutron source.

23. The personal wireless device as claimed in claim 22 wherein the diode is selected from the group consisting of boron, lithium doped, coated ultra pure diodes and combinations thereof.

24. The personal wireless device as claimed in claim 18 wherein the radiation sensor includes a nanowire for electron tunneling in a nanowire.

25. The personal wireless device as claimed in claim 24 wherein the nanowire includes boron-doped silicon nanowires having a gap.

26. The personal wireless device as claimed in claim 25 further comprising an embedded capture area consisting of lithium.

27. The personal wireless device as claimed in claim 25 further comprising an embedded capture area consisting of boron 6.

28. The personal wireless device as claimed in claim 18 wherein the radiation sensor includes an electronic directional semiconductor neutron sensor with amplification.

29. The personal wireless device as claimed in claim 28 wherein the radiation sensor further includes a neutron concentration means having a miniature beryllium concave dish.

30. The personal wireless device as claimed in claim 18 wherein the wireless device is a modified mobile phone and wherein the radiation sensor further includes internal logic gate components of a mobile phone whereby radiation sensitive, radiation hardened, and shielded areas provided directly within the internal circuitry of said mobile phone.

31. The personal wireless device as claimed in claim 18 wherein the radiation sensor further includes a miniature Geiger-Muller tube.

32. The personal wireless device as claimed in claim 18 wherein the radiation sensor further includes a Direct Ion Storage MOSFET transistor.

33. The personal wireless device as claimed in claim 18 wherein the device further comprises multiple miniature solid state radiation detectors for dual gamma and neutron recognition having built in software and calibration means to recognize specific radiation signatures with said detectors.

34. The personal wireless device as claimed in claim 18 further comprising a function for turning the wireless device off but leaving the radiation sensor and notification means on, thereby allowing conservation of a power-supply system.

35. The personal wireless device as claimed in claim 14 wherein the sensor detects the level of chemical agents present in the surrounding area.

36. The personal wireless device as claimed in claim 35 wherein the sensor further comprises fully reversible sensor arrays that can measure a number of different chemical components simultaneously.

37. The personal wireless device as claimed in claim 35 wherein the sensor further comprises a self-contained disposable chemical nose comprising multiple sensors or a sensor array.

38. The personal wireless device as claimed in claim 37 wherein the chemical nose further comprises:

a counter made of a degradable compound for determining the time to replace the chemical nose; and a humidity sensor.

39. The personal wireless device as claimed in claim 37 wherein the sensor includes conjugated polymers.

40. The personal wireless device as claimed in claim 37 wherein the sensor includes chemicals doped with nanoparticles.

41. The personal wireless device as claimed in claim 14 wherein said sensor is a dual detection sensor whereby chemical agents and radiation levels are both capable of being detected.

42. The personal wireless device as claimed in claim 14 wherein the sensor includes a biological agent sensor that can detect the level of biological agents present in the surrounding area.

43. The personal wireless device as claimed in claim 14 wherein the sensor is able to detect anthrax.

44. The personal wireless device as claimed in claim 1 further comprising a built-in power supply system.

45. The personal wireless device as claimed in claim 44 wherein said built-in power supply includes a rechargeable battery.

46. The personal wireless device as claimed in claim 44 wherein the built-in power system consists of a one-use battery supply.

47. The personal wireless device as claimed in claim 1 wherein the device includes two-way voice communication circuitry.

48. The personal wireless device as claimed in claim 1 wherein the device includes text communication circuitry.

49. The personal wireless device as claimed in claim 1 wherein the notification signal is selected from the group consisting of audible alarms, text alarms, and direct connection to an emergency response system, and combinations thereof.

50. The personal electronic device as claimed in claim 1 wherein a person-specific profile of hazardous agents can be determined by the use of the user interface.

51. The personal electronic device as claimed in claim 1 wherein the at least one hazardous agent causes person-specific chemical allergies.

52. The personal electronic device as claimed in claim 1 wherein the hazardous agent causes person-specific asthma due to the presence of certain specific chemicals in the air.

53. The personal electronic device as claimed in claim 1 wherein the hazardous agent causes a person-specific radiation-sensitivity.

54. The personal electronic device as claimed in claim 1 that is able to detect a person-specific medical condition that is triggered by at least one hazardous agent by the use of a specific sensor module.

55. The personal electronic device as claimed in claim 54 wherein the electronic device further provides the capability of compiling a library of person-specific sensor values associated with the onset of said medical condition.

56. The personal electronic device as claimed in claim 1 wherein said storage device is a secure database.

57. The personal electronic device as claimed in claim 56 wherein the storage means contains data collected by said sensor module and said data is used to produce person-specific tailored drugs or treatments.

58. The personal electronic device as claimed in claim 1 wherein the sensor module includes a disposable nose.

59. A method of detecting a personalized level of an agent hazardous to human health, said method comprising the steps of:

a. providing a wireless device having a transceiver and a slot for receiving an interchangeable sensor module;

b. said wireless device further having a user interface;

c. inserting in said slot a sensor module having at least one sensor which can detect the identity and quantity of at least one hazardous agent;

d. transporting said wireless device from location to location via a user;

e. when said user undergoes a physiological change due to a hazardous agent, recording the identity and quantity of said at least one hazardous agent in a storage means using said user interface; and f. repeating steps "a" through "e" to train said wireless device to emit an alarm when the wireless device detects the type and quantity of said at least one hazardous agent which evokes said physiological response in said user.

60. The method as claimed in claim 59 further comprising the step of providing network software and recording the identity and quantity of said at least one hazardous agent to a remote storage means.

61. The method as claimed in claim 60 wherein said network software also eliminates false positives.

62. The method as claimed in claim 59 further comprising using a geo-location positioning means in order to detect the location of said wireless device providing the hazardous detection information.

63. The method as claimed in claim 62 wherein said geo-location positioning means is based on land-based triangulation geo-positioning methods.

64. The method as claimed in claim 62 wherein said geo-location positioning means is based on a global positioning satellite system.

65. The method as claimed in claim 62 wherein said geo-location positioning means is based on a combination of land-based triangulation positioning methods and global positioning satellite systems.

66. The method as claimed in claim 59 wherein said transceiver communicates with an emergency network response system which includes 911 and E911.

67. The method as claimed in claim 59 wherein said wireless device are modified mobile phones.

68. The method as claimed in claim 67 wherein said modified mobile phones are disposable.

69. The method as claimed in claim 59 wherein said wireless device is a modified Personal Digital Assistant.

70. The method as claimed in claim 59 wherein said wireless device is a modified two-way pager.

71. The method as claimed in claim 59 wherein said wireless device is a modified watch.

72. The method as claimed in claim 59 wherein said transceiver communicates with any remote network in any given country.

* * * * *

UNITED STATES PATENT AND TRADEMARK OFFICE

CERTIFICATE OF CORRECTION

PATENT NO. : 7,109,859 B2
APPLICATION NO. : 10/382606
DATED : September 19, 2006
INVENTOR(S) : John Peeters It is certified that error appears in the above-identified patent and that said Letters Patent is hereby corrected as shown below:

Column 26, lines 54 and 55 (Claim 46), "built-in power system consists of a one-use battery supply" should be --built-in power supply system consists of a one-use battery--

Column 26, line 64 (Claim 49), "response system, and combinations"should be --response system and combinations--

Signed and Sealed this

Twelfth Day of December, 2006

JON W. DUDAS
*Director of the United States Patent and Trademark Office*